US006758725B1

(12) United States Patent
Sudo et al.

(10) Patent No.: US 6,758,725 B1
(45) Date of Patent: Jul. 6, 2004

(54) LAPPING METHOD AND LAPPING APPARATUS

(75) Inventors: Koji Sudo, Kawasaki (JP); Yoshiaki Yanagida, Kawasaki (JP); Tomokazu Sugiyama, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 222 days.

(21) Appl. No.: 09/671,725

(22) Filed: Sep. 27, 2000

(30) Foreign Application Priority Data

Dec. 7, 1999 (JP) ..... 11-348147

(51) Int. Cl.[7] ..... B24B 1/00

(52) U.S. Cl. ..... 451/41; 451/286; 451/287; 451/270; 451/272

(58) Field of Search ..... 451/41, 286, 287, 451/270, 272

(56) References Cited

U.S. PATENT DOCUMENTS 5,203,119 A 4/1993 Cole
5,620,356 A 4/1997 Lackey et al.
5,735,036 A * 4/1998 Barr et al. ..... 29/603.12
6,217,425 B1 * 4/2001 Shindou et al. ..... 451/259
6,238,276 B1 * 5/2001 Miyazaki et al. ..... 451/266

FOREIGN PATENT DOCUMENTS

| | | |
|---|---|---|
| JP | 5123960 | 5/1993 |
| JP | 10286767 | 10/1998 |
| JP | 11016124 | 6/1999 |

* cited by examiner

*Primary Examiner*—Joseph J. Hail, III
*Assistant Examiner*—Shantese McDonald
(74) *Attorney, Agent, or Firm*—Greer, Burns & Crain, Ltd.

(57) ABSTRACT

A lapping method includes a step of moving a substantially bar-shaped workpiece in a radial direction of a surface of a rotary lapping plate while simultaneously oscillating the workpiece pivotally about a central point in a longitudinal direction of the workpiece in a plane parallel to the surface of the rotary lapping plate.

10 Claims, 32 Drawing Sheets

LAPPING METHOD AND LAPPING APPARATUS

BACKGROUND OF THE INVENTION

1. Field of the Invention

The present invention relates generally to a lapping method and lapping apparatus, and more particularly, to a lapping method and lapping apparatus used in the manufacture of slider-mounted composite magnetic heads.

2. Description of Related Art

For clarity of explanation, a description will first be given of the structure of a slider-mounted composite magnetic head used in disk drives for recording information to and/or reproducing information from a recording medium.

FIGS. 1A and 1B are diagrams for explaining a slider-mounted composite-type magnetic head. FIG. 1A shows an expanded cross-sectional view of a portion of a slider-mounted composite magnetic head 1. The slider-mounted composite magnetic head 1 has a composite magnetic head 11 at a tip of a ceramic slider 2. The composite magnetic head 11 has a magnetoresistive head element 3 for reproducing information and an inductive head element 4 for recording information.

As shown in FIG. 1B, the magnetoresistive head element 3 is a thin film comprised of a magnetoresistive film 5 provided on a lower side of the head 1 that faces laterally, with a pair of conductive film terminals 6*a*, 6*b* connected to either end of the magnetoresistive film 5. The resistance of the magnetoresistive film 5 changes depending on the external magnetic field to which it is exposed and a sense current is sent through the magnetoresistive film 5. Thus, when the head 1 scans a disk, the resistance of the magnetoresistive film 5 changes according to the magnetization of the disk tracks T over which the head 1 scans and thus a voltage across the conductive film terminals 6*a*, 6*b* also changes, with the result that the information recorded on the disk tracks T is read out as changes in voltage.

The inductive head element 4 is also a thin film, with a lower electrode 7, an upper electrode 8, and a coil 9 located between the lower electrode 7 and the upper electrode 8. When the head 1 scans the disk, signals of information to be written onto the disk are supplied to the coil 9 and a magnetic field is extruded from a lower magnetic gap 10 between the lower electrode 7 and the upper electrode 8. This magnetic field writes information to the tracks T of the disk.

In manufacturing the slider-mounted composite magnetic head 1 having the structure described above, it is desirable that the resistance of the magnetoresistive film 5 be the same or nearly the same for all such heads so fabricated. Generally, as will be described in detail later, this uniformity of resistance is achieved by lapping so that a thickness or height h of the magnetoresistive film 5 is the same for all slider-mounted composite magnetic heads 1, such that the heads 1 achieve a predetermined resistance value.

Next, a description will be given of the process of manufacturing the above-described slider-mounted composite magnetic head 1, with reference to FIGS. 2A, 2B, 2C, 2D, 3A, 3B, 4A, 4B and 4C.

FIGS. 2A, 2B, 2C and 2D show initial steps in a process of manufacturing the slider-mounted composite magnetic head 1. FIGS. 3A and 3B show further steps in the process of manufacturing the slider-mounted composite magnetic head 1 shown in FIGS. 2A, 2B, 2C and 2D. FIGS. 4A, 4B and 4C show remaining steps in the process of manufacturing the slider-mounted composite magnetic head 1 shown in FIGS. 3A and 3B.

Generally, the manufacture of such heads involves the following steps, in the following order: Patterning, dicing, attaching, grinding, lapping, dicing, and peeling.

Initially, a pattern is formed on a ceramic wafer 20 as shown in FIG. 2A using thin film technology. Composite magnetic heads 11 and ELG (Electronic Lapping Guide) elements are laid down in alternate sequence as shown in FIGS. 2B and 2C. The wafer 20 has a thickness corresponding to a length a of the slider. The wafer 20 is then diced and, as shown in FIG. 2B, a multiplicity of row bars 22 are obtained. The row bar 22, which as can be appreciated is in the shape of a bar, has a composite magnetic head 11 and an ELG element 21 laid down in alternate sequence, together with a margin portion 23 to be ground or lapped. It should be noted that the magnetoresistive film 5 and the ELG element 21 are both formed by thin-film technology patterning, and the magnetoresistive film 5 and ELG element 21 are positioned with a high degree of accuracy.

Next, as shown in FIG. 3A, the row bar 22 is attached to a tip of a transfer tool 30 using wax. A multiplicity of concave portions 31 are formed along the tip of the transfer tool 30. The row bar 22, as shown in FIG. 3B, is attached so that the ELG elements 21 are disposed opposite the concave portions 31. The concave portions 31 are formed so as not to interfere with the dicing step to follow. The transfer tool 30 is fixedly mounted to a printed circuit board 32. The ELG elements 21 and terminals on the printed circuit board 32 are connected, or bonded, by wire 33 as shown in FIG. 3B, thus connecting the ELG elements 21 and the printed circuit board 32 electrically.

Next, the transfer tool 30 to which the row bar 22 is attached is set to a grinding machine not shown in the diagram and the row bar 22 is ground down to a point indicated by a dashed line 34 in FIG. 3B.

Next, the transfer tool 30 is removed from the sander and set to a lapping device not shown in the drawing in order to lap the ground surface of the row bar as shown in FIG. 4A. As lapping progresses, the width, that is, the height h of the magnetoresistive film 5 gradually decreases, as does the height of the ELG elements 21, and, accordingly, the magnetic resistance MRh gradually increases. Moreover, because the magnetoresistive film 5 and the ELG 21 are positioned with great precision, it is possible to know the height of the magnetoresistive film 5 from the condition of the ELG elements 21. Therefore lapping is conducted while monitoring the magnetic resistance MRh of the ELG 21. When this magnetic resistance MRh of the ELG elements 21 reaches a target value, lapping is discontinued. At this point in time the height h of the magnetoresistive film 5 should have reached its target value. This lapping process is very precise, that is, on the order of sub-microns.

Next, the transfer tool 30 is removed from the lapping device and set to a dicing device not shown in the diagram and, as shown in FIG. 4B, the lapped row bar 22 is cut through to the interior of the concave portions 31 using a dicing saw 35, thus cutting out the row bar 22 ELG elements 21. In so doing, the row bar 22 is separated into a plurality of heads 1.

Finally, the transfer tool 30 is heated so as to melt the wax holding the row bar 22 onto the tip of the transfer tool 30. In so doing, the plurality of heads 1 into which the cut row bar 22 has been divided peel off from the transfer tool 30, resulting in fully formed slider-mounted composite magnetic heads 1 having a height b of approximately 0.3 mm and a length a of approximately 1.2 mm.

It will be appreciated by those skilled in the art that the production process described above is also used to fabricate giant magnetoresistive heads, or GMR heads, having a plurality of different film layers in contrast to the single layer of the magnetoresistive film characteristic of magnetoresistive heads described above.

A description will now be given of the conventional art.

FIG. 5 shows a perspective view of a conventional lapping device for lapping a row bar, as shown for example in Japanese Laid-Open Patent Application No. 10-286767. As shown in the diagram, this conventional lapping device 40 has a base 41, a rotary plate 42 that rotates in a direction indicated by arrow A in the diagram, an arm assembly 44 supported by a shaft 43, an oscillating mechanism 45 that swings the arm assembly 44 about the shaft 43 in directions indicated by double-headed arrow B in the diagram, and a ring 46 that rotates in a direction indicated by arrow C in the diagram so as to spread a slurry across an upper surface of the rotary lapping plate 42. Additionally, the conventional lapping device 40 also has a detachable adapter 50.

FIG. 6 shows the rotary lapping plate and associated parts depicted in FIG. 5. FIG. 7 shows a side view of the assembly shown in FIG. 6, including an unload mechanism 51 and an unload block 52 to be described later. FIG. 8 shows a schematic view of an adapter portion.

The transfer tool 30A having the ground row bar 22 is mounted on the adapter 50 as shown in FIGS. 6, 7 and 8. As can be appreciated from the drawings, particularly FIG. 8, the adapter 50 has a generally paddle-shaped form. Further, the adapter 50 is mounted on the arm assembly 44. By oscillating the arm assembly 44, the ground row bar 22 is moved along an upper surface of the rotary lapping plate 42 in a direction of a radius of the rotary lapping plate 42 at a rate of approximately one cycle every 10 seconds. It should be noted that the rotary lapping plate 42 is at this time rotating at approximately 15 rpm.

When the resistance MRh of the ELG elements reaches a target value, the unload mechanism 51 is activated and the unload block 52 is moved in a direction indicated by arrow D in FIG. 7. The movement of the unload block in the direction of arrow D forces the adapter 50 upward to a position indicated by the double-dot-and-chain line in FIG. 7, which in turn lifts the lapped row bar 22 off the rotary lapping plate 42, completing the lapping operation.

However, the lapping system described above has several disadvantages.

First, the manner in which the lapped row bar 22 is unloaded from the rotary lapping plate 42 degrades the precision of the lapping.

In the finished product, the lapped surface of the row bar 22 becomes an air-bearing surface that floats above the disk-like recording medium, so the rotary lapping plate 42 must not leave any scratches or scars on this surface.

However, when the row bar 22 reaches the end of its arcuate oscillation, that is, when the row bar 22 attains positions Q1 and Q2 at the end of its swing as indicated in FIG. 6, the row bar 22 naturally stops at such positions. If the row bar 22 is unloaded from the rotary lapping plate 42 at these positions at which the motion of the row bar 22 has terminated, then it is possible that the rotary lapping plate 42 will scratch the lapped surface of the row bar 22 in the interval of time after which the motion of the row bar 22 has stopped but before the row bar 22 is unloaded. For this reason, then, unloading is restricted to an area near a point P as indicated in FIG. 6, that is, near a middle of the arc through which the row bar 22 travels across the upper surface of the rotary lapping plate 42.

As a result, however, it is not possible to promptly unload the row bar 22 at the point in time at which the resistance of the ELG elements 21 attains the target value because the row bar 22 may be out of position, that is, the row bar 22 may be near positions Q1 and Q2, thus forcing a delay of up to several seconds before the row bar 22 can be unloaded. During this interval the row bar 22 continues to be lapped beyond the level required, thus degrading the precision of the lapping process. With recent advances in recording medium density technology, excess-lapping deviations of even one micron have become unacceptable.

Second, the conventional lapping system as described above depends too greatly on the skill of the human operator.

As shown for example in FIG. 7, when beginning lapping, the operator must mount the transfer tool 30 (to which the ground row bar 22 has been attached) onto the adapter 50 and then mount the adapter 50 onto the arm assembly 44.

However, deviations arise in the mounting of the adapter 50 onto the arm assembly 44, and such differences result in unevenness in the contact of the row bar 22 with the upper surface of the rotary lapping plate 42. These deviations can damage the soft tin surface of the rotary lapping plate 42 and degrade the precision of the lapping itself.

Third, the working life of a ceramic stopper 53 on the arm assembly 44 is short.

Specifically, the arm assembly 44 continues to oscillate even after lapping has been completed, keeping the ceramic stopper 53 at the tip of the arm assembly 44 in continuous abrasive contact with the rotary lapping plate 42, thus shortening the useful life of the stopper 53.

Fourth, the lapping process according to the lapping system as described above can be unstable. The extent to which the stopper 53 is abraded creates an unbalance at the tip of the arm assembly 44 during lapping which may cause the tip of the arm assembly 44 to vibrate, disrupting the stability of the row bar 22 and degrading the precision of the lapping.

BRIEF SUMMARY OF THE INVENTION

Accordingly, it is a general object of the present invention to provide an improved and useful lapping method and lapping apparatus, in which the above-described disadvantages are eliminated.

The above-described object of the present invention is achieved by a lapping method including a step of moving a substantially bar-shaped workpiece in a radial direction of a surface of a rotary lapping plate while simultaneously oscillating the workpiece pivotally about a central point in a longitudinal direction of the workpiece in a plane parallel to the surface of the rotary lapping plate.

According to the invention described above, the workpiece can be maintained in constant motion across the surface of the rotary lapping plate. As a result of this constant motion it is more difficult for the rotary lapping plate to scratch or scar the lapped surface of the row bar, so the degree of precision with which the row bar is lapped can be improved.

Additionally, the above-described object of the present invention is also achieved by a lapping apparatus comprising:

a rotary lapping plate;

an arcuate movement mechanism returnably moving a substantially bar-shaped workpiece repeatedly in a radial direction of a surface of the rotary lapping plate; and an oscillating mechanism oscillating the workpiece pivotally about a central point in a longitudinal direction of the workpiece in a plane parallel to the surface of the rotary lapping plate, the oscillating mechanism being supported on and by the arcuate movement mechanism.

According to the invention described above, the workpiece can be maintained in constant motion across the surface of the rotary lapping plate. As a result of this constant motion it is more difficult for the rotary lapping plate to scratch or scar the lapped surface of the row bar, and thus the degree of precision with which the row bar is lapped can be improved.

Additionally, the above-described object of the present invention is also achieved by a lapping apparatus comprising:

a rotary lapping plate;

an oscillating mechanism oscillating a workpiece pivotally about a central point of the workpiece while maintaining the workpiece in sliding contact with an upper surface of the rotary lapping plate, the mechanism having a stopper that slidingly contacts the upper surface of the rotary lapping plate; and a loading/unloading mechanism that moves the stopper of the oscillating mechanism in a loading direction toward the rotary lapping plate and an unloading direction away from the rotary lapping plate.

According to the invention described above, the stopper is removed from contact with the rotary lapping plate, thereby preventing unnecessary abrasion of the stopper and thus extending the useful life of the stopper.

Additionally, the above-described object of the present invention is also achieved by a lapping apparatus comprising:

a rotary lapping plate;

an oscillating mechanism oscillating a workpiece pivotally about a central point of the workpiece while maintaining the workpiece in sliding contact with an upper surface of the rotary lapping plate, the mechanism having a stopper that slidingly contacts the upper surface of the rotary lapping plate; and a wiper unit having a blade portion that contacts the upper surface of the rotary lapping plate, the wiper unit being activated to remove a rough slurry supplied to the upper surface of the rotary lapping plate before a smooth slurry is supplied to the upper surface of the rotary lapping plate.

According to the invention described above, by activating the wiper unit to after the rough slurry has been applied but before the smooth slurry is applied improves the precision of the lapping.

Other objects, features and advantages of the present invention will become more apparent from the following detailed description when read in conjunction with the accompanying drawings.

DETAILED DESCRIPTION OF THE INVENTION

A description will now be given of embodiments of the present invention, with reference to the accompanying drawings.

It should be noted that identical or corresponding elements in the embodiments are given identical or corresponding reference numbers in all drawings and detailed descriptions of those elements are given only once and thereafter omitted.

Figure 1A:
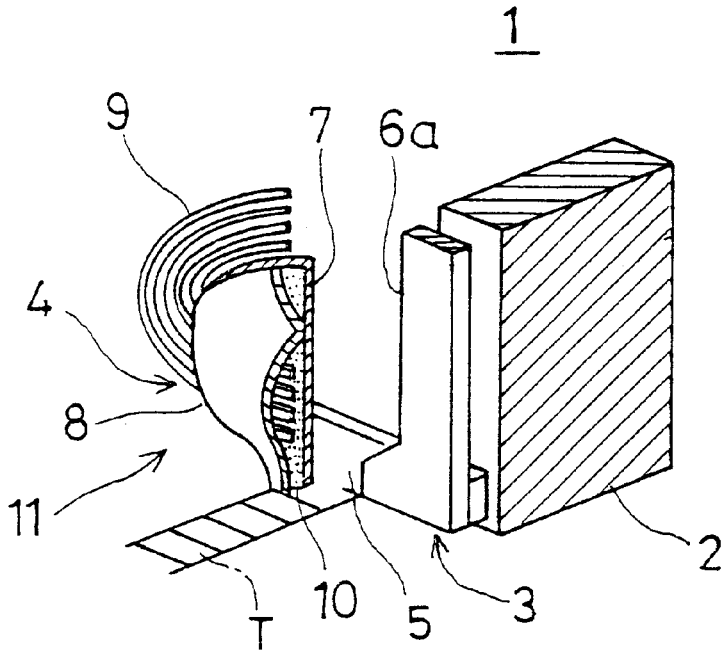
FIG. 1A PRIOR ART
FIGS. 1A and 1B are diagrams for explaining a slider-mounted composite-type magnetic head.
Figure 1B:
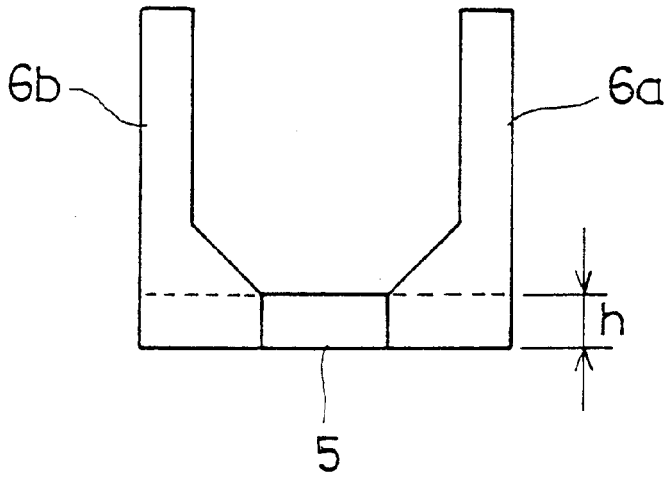
FIG. 1B PRIOR ART
Figure 2A:
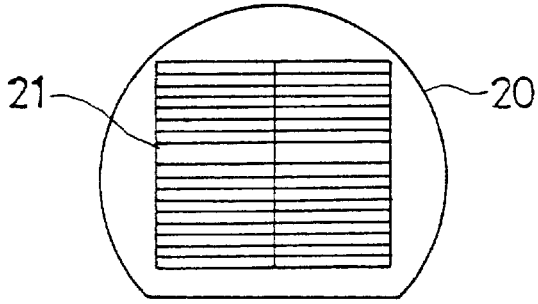
FIG. 2A PRIOR ART
FIGS. 2A, 2B, 2C and 2D are diagrams showing initial steps in a process of manufacturing the slider-mounted composite magnetic head 1.
Figure 2B:
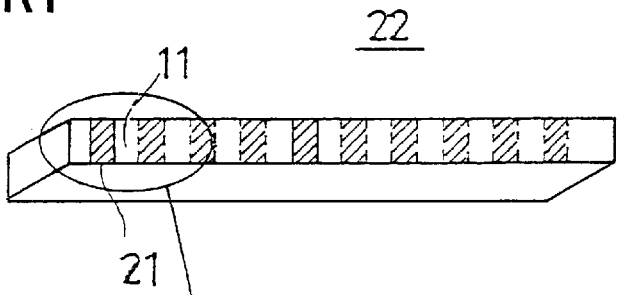
FIG. 2B PRIOR ART
Figure 2C:
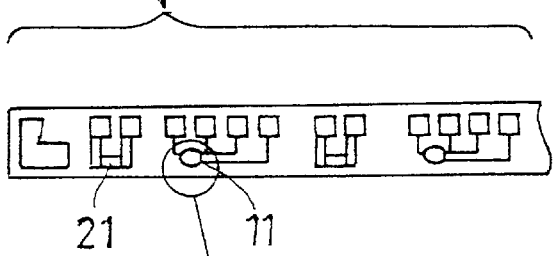
FIG. 2C PRIOR ART
Figure 2D:
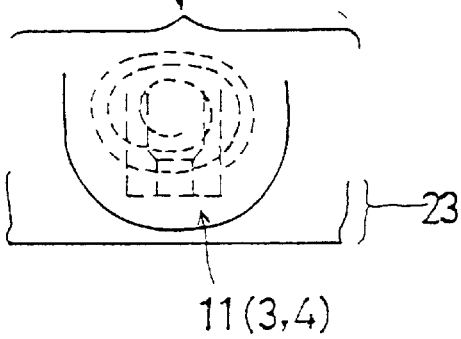
FIG. 2D PRIOR ART
Figure 3A:
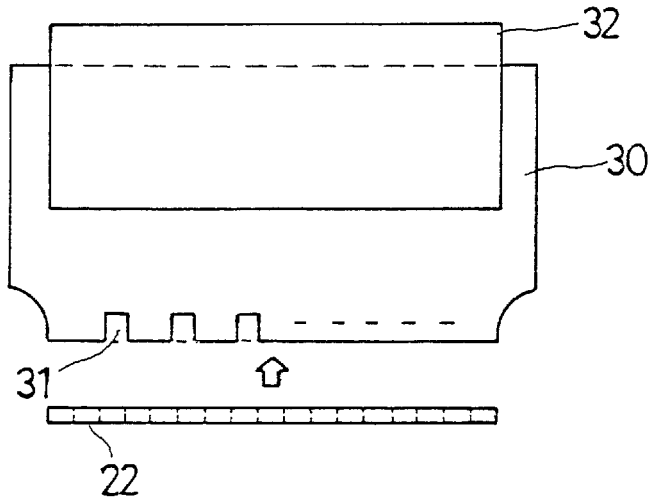
FIG. 3A PRIOR ART
FIGS. 3A and 3B are diagrams showing further steps in the process of manufacturing the slider-mounted composite magnetic head 1 shown in FIGS. 2A, 2B, 2C and 2D.
Figure 3B:
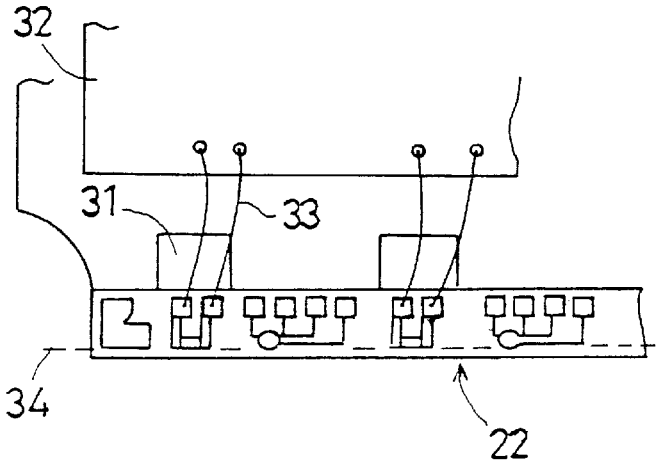
FIG. 3B PRIOR ART
Figure 4A:
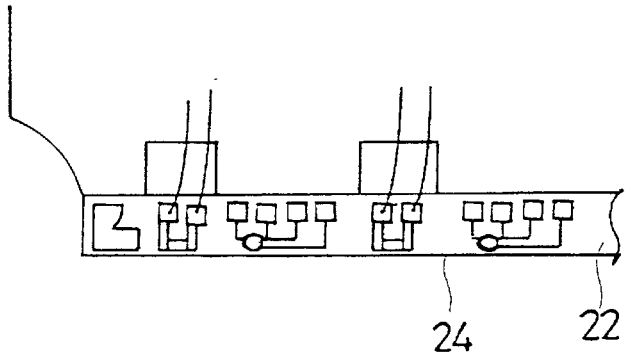
FIG. 4A PRIOR ART
FIGS. 4A, 4B and 4C are diagrams showing remaining steps in the process of manufacturing the slider-mounted composite magnetic head 1 shown in FIGS. 3A and 3B.
Figure 4B:
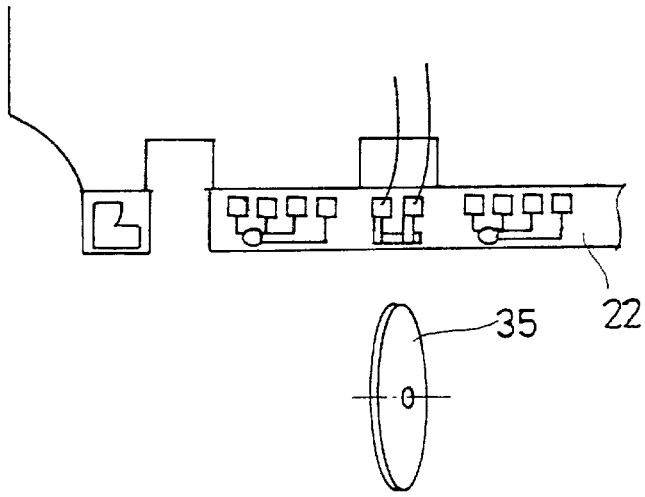
FIG. 4B PRIOR ART
Figure 4C:
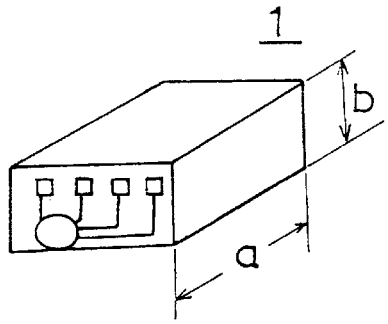
FIG. 4C PRIOR ART
Figure 5:
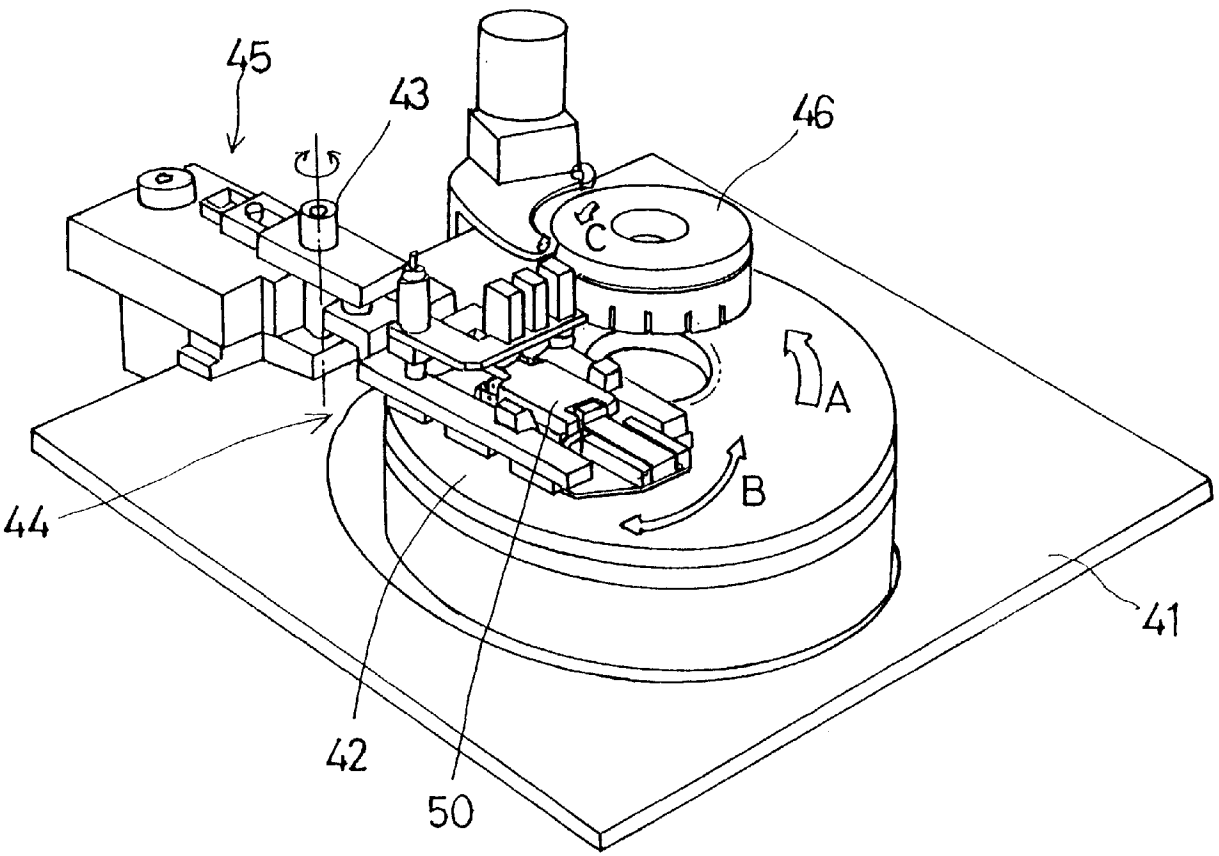
FIG. 5 PRIOR ART
FIG. 5 is a perspective view of a conventional lapping device for lapping a row bar.
Figure 6:
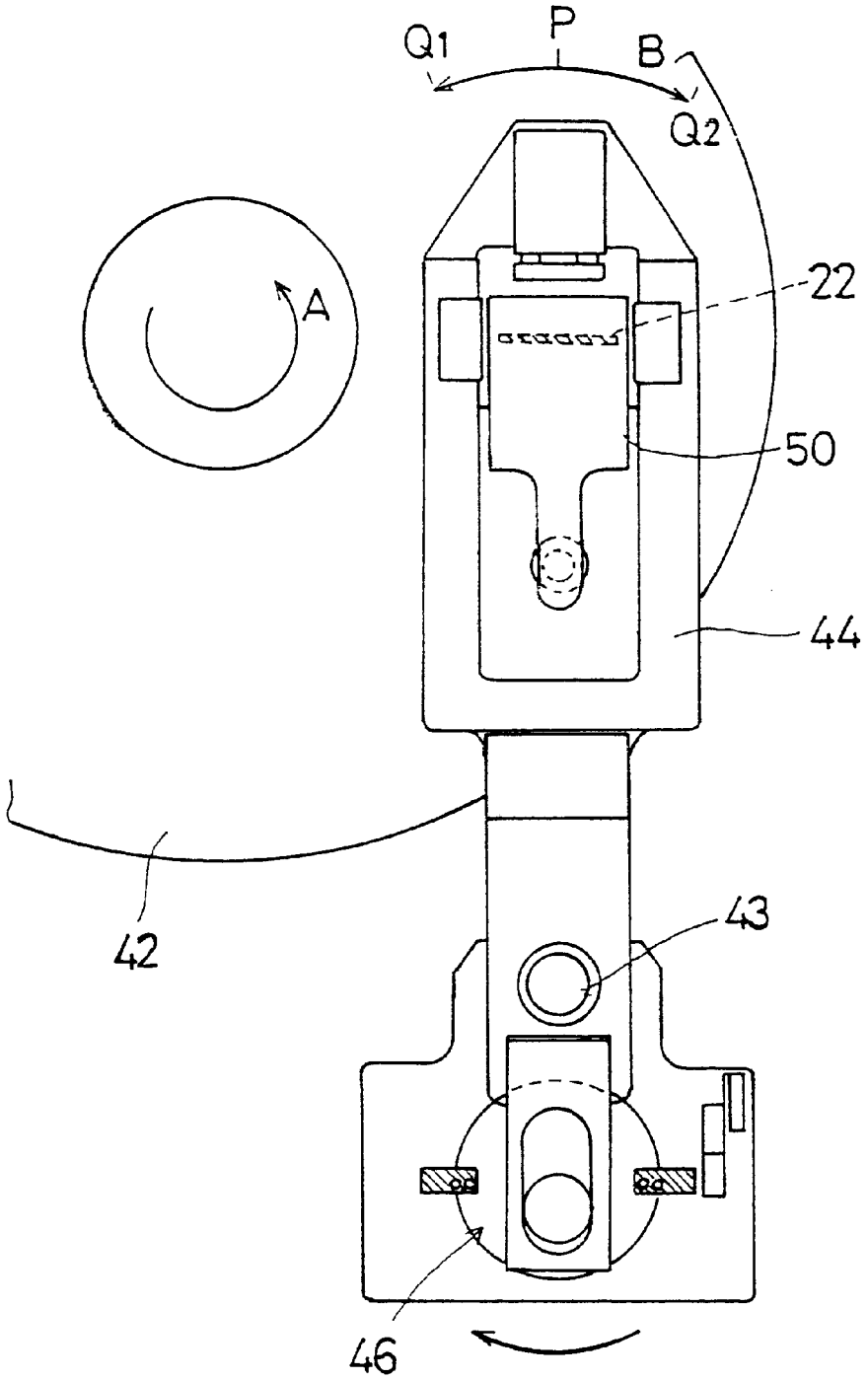
FIG. 6 PRIOR ART
FIG. 6 shows the rotary lapping plate and associated parts depicted in FIG. 5.
Figure 7:
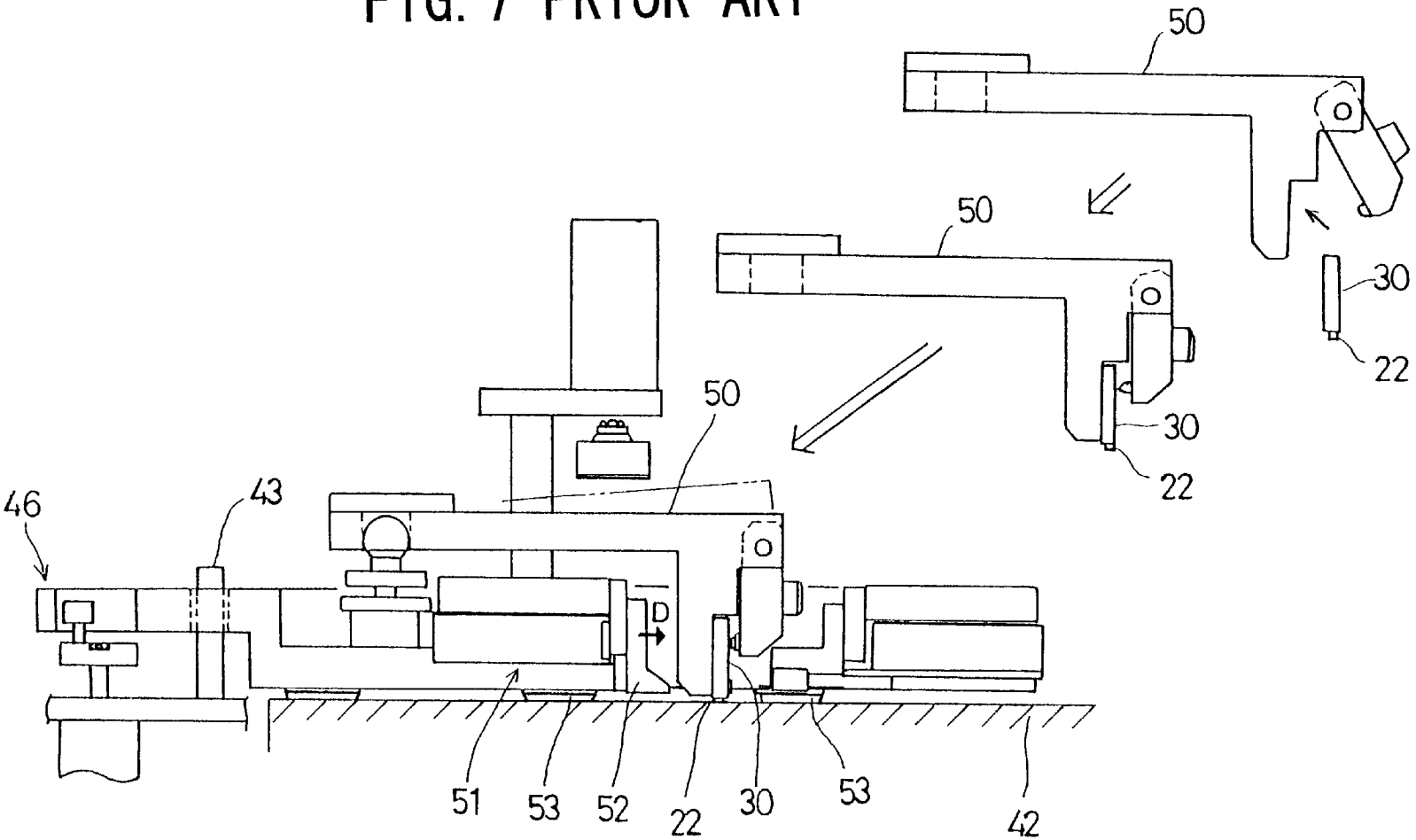
FIG. 7 PRIOR ART
FIG. 7 is a side view of the assembly shown in FIG. 6.
Figure 8:
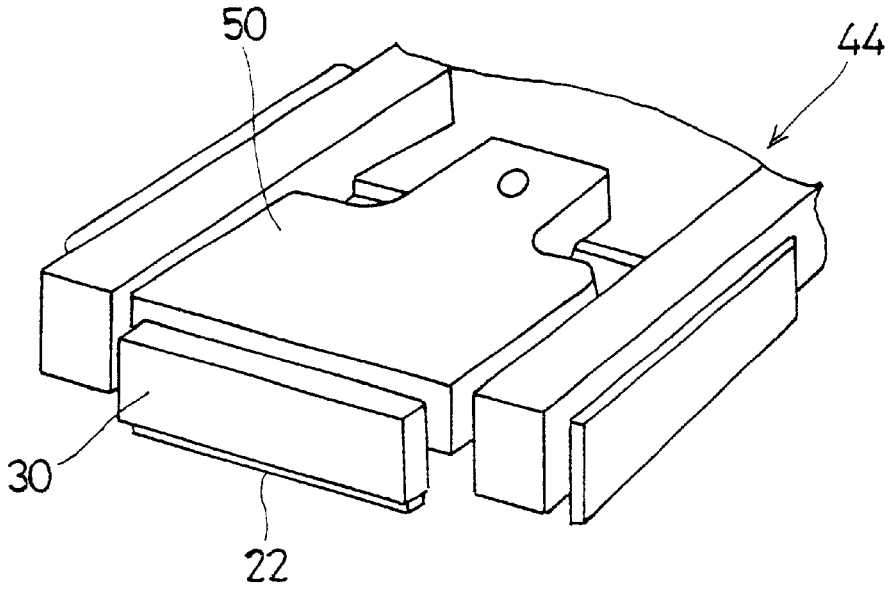
FIG. 8 PRIOR ART
FIG. 8 is a schematic view of an adapter portion.
Figure 9:
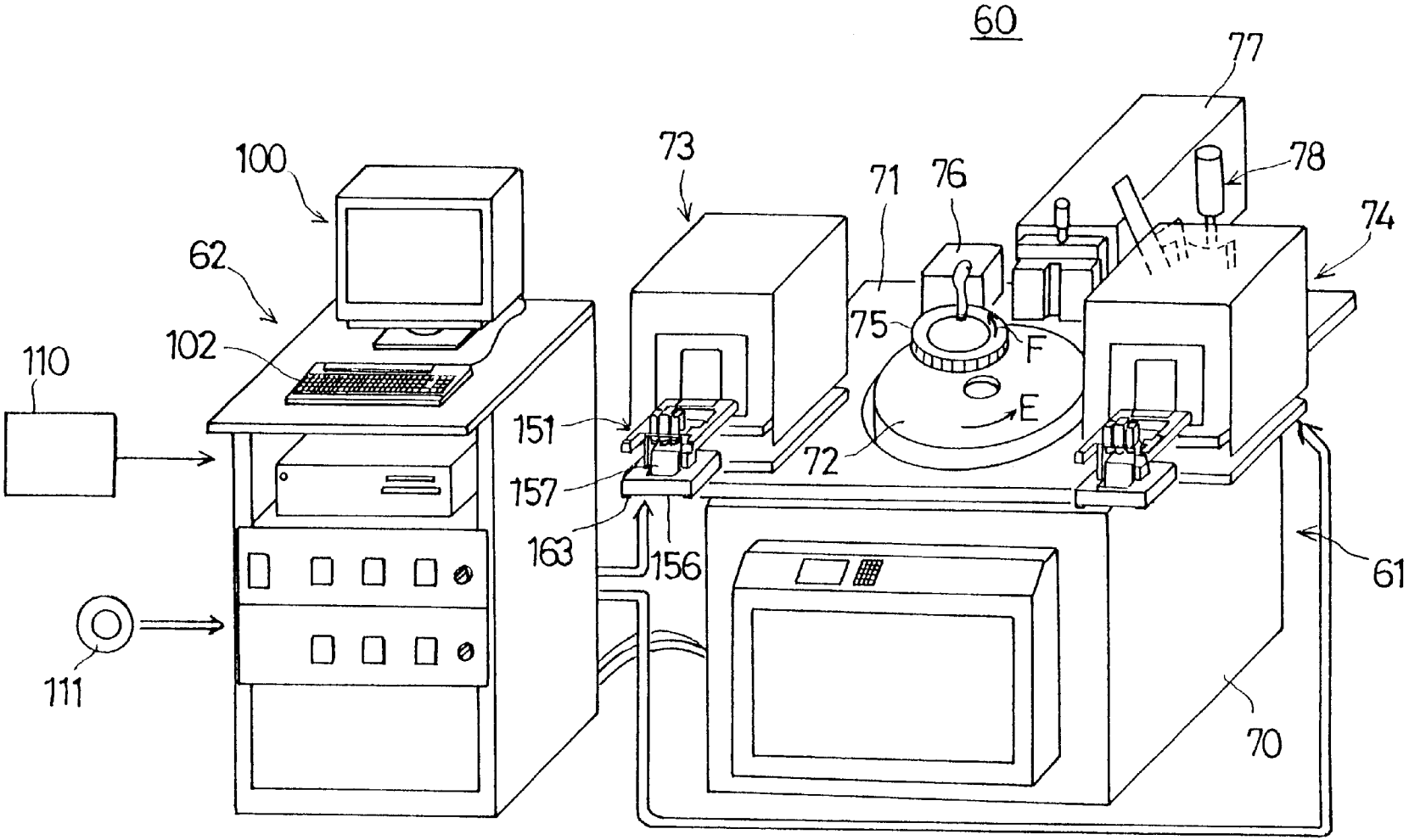
FIG. 9 shows a lapping apparatus according to one embodiment of the present invention.
Figure 10:
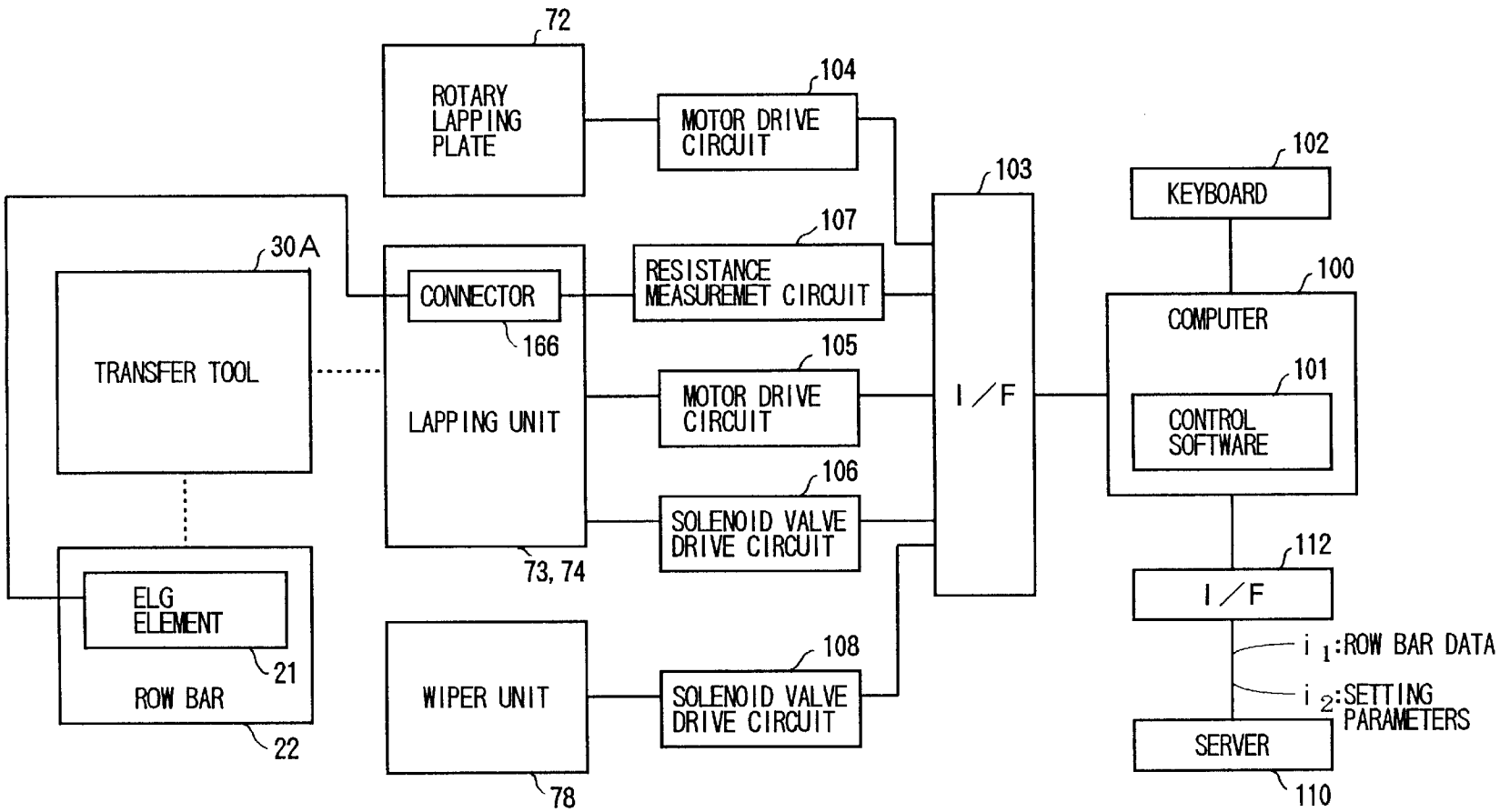
FIG. 10 is a block diagram of the lapping apparatus depicted in FIG. 9.

FIG. 9 shows a lapping apparatus 60 according to one embodiment of the present invention. FIG. 10 is a block diagram of the lapping apparatus 60 depicted in FIG. 9. As shown in the diagrams, in broad terms the lapping apparatus comprises a lapping device 61 and a control unit 62.

Figure 11:
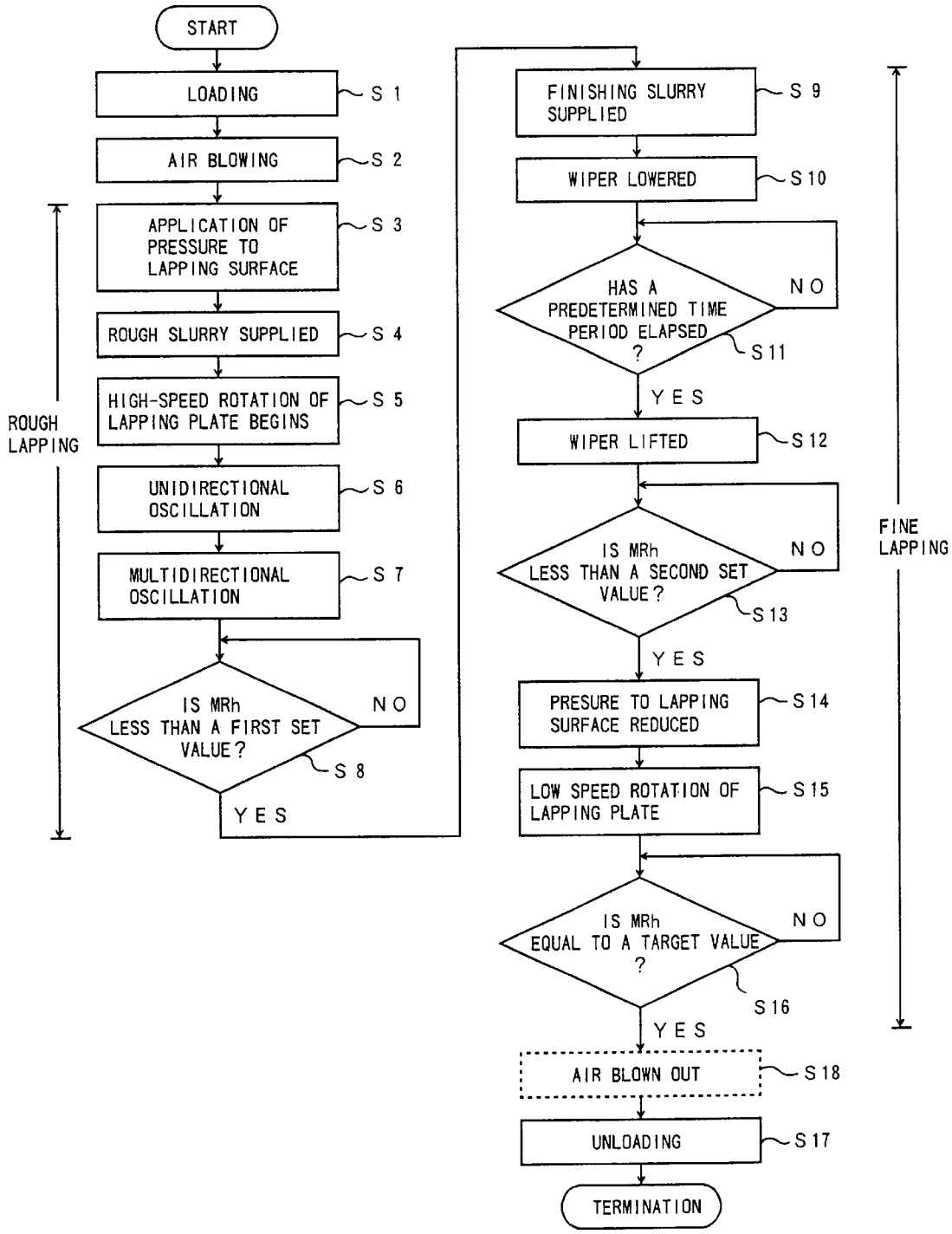
FIG. 11 is a flow chart of the lapping process.
Figure 12:
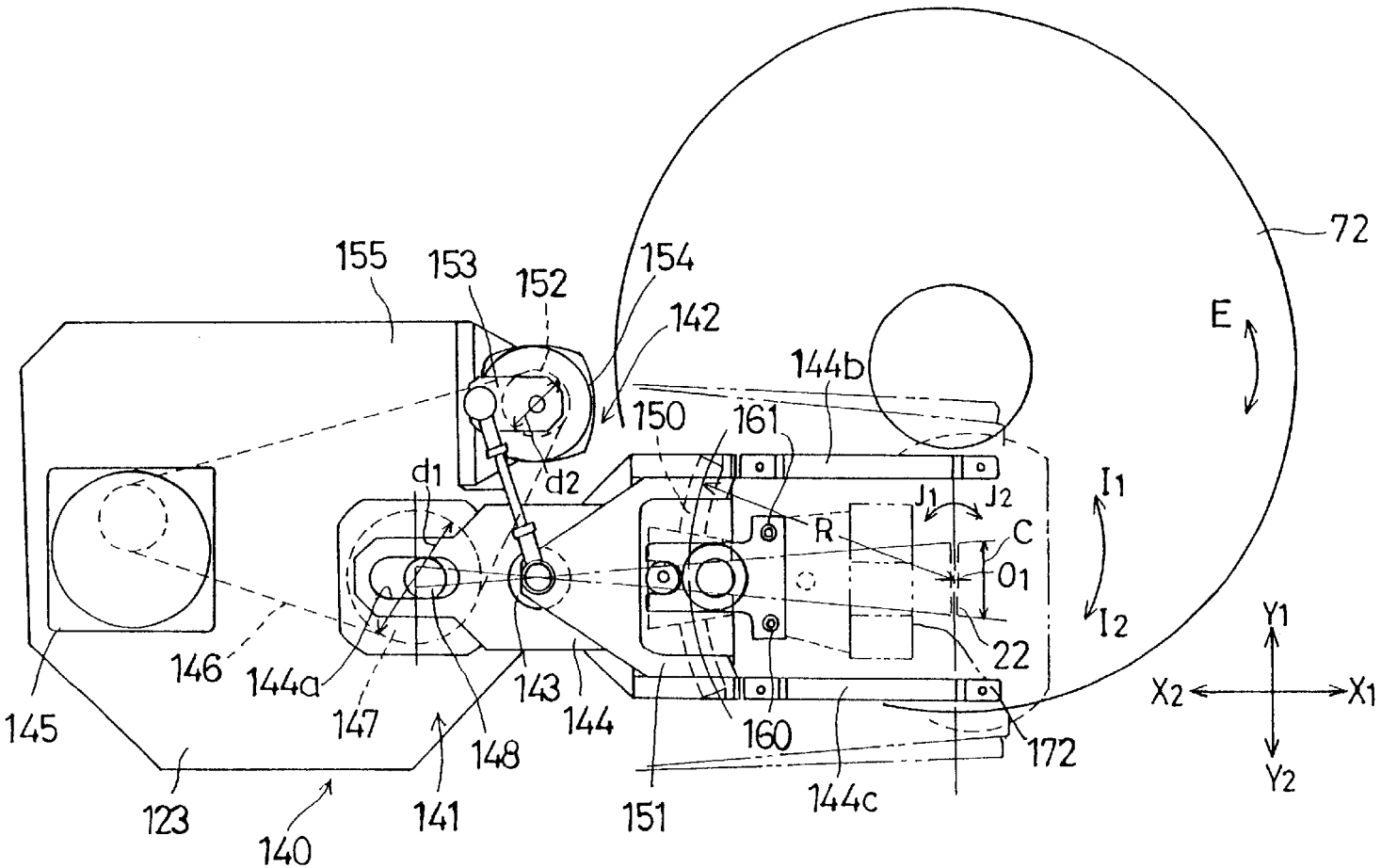
FIG. 12 is a plan view of the lapping apparatus.
Figure 13:
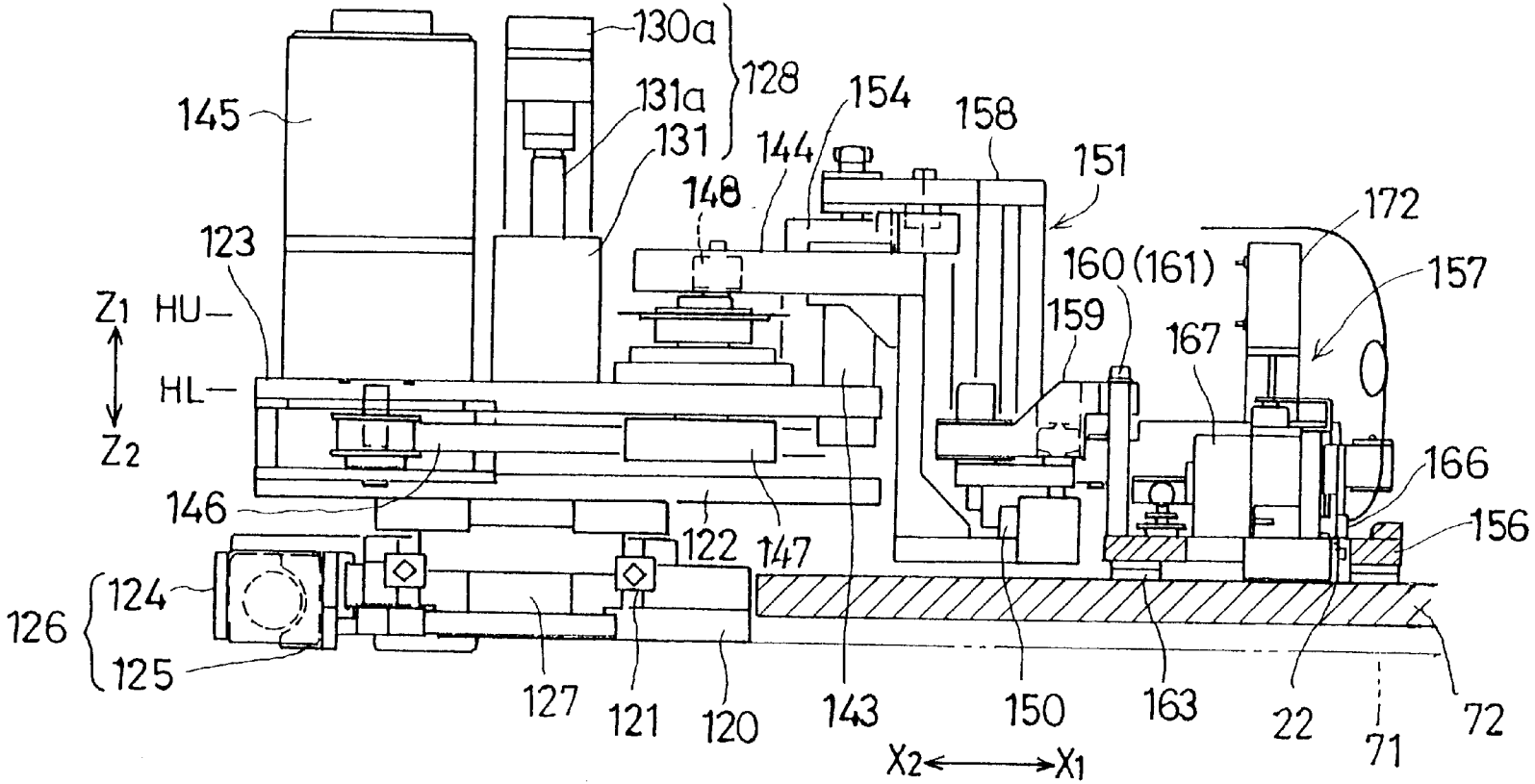
FIG. 13 is a side view of the lapping apparatus.
Figure 14:
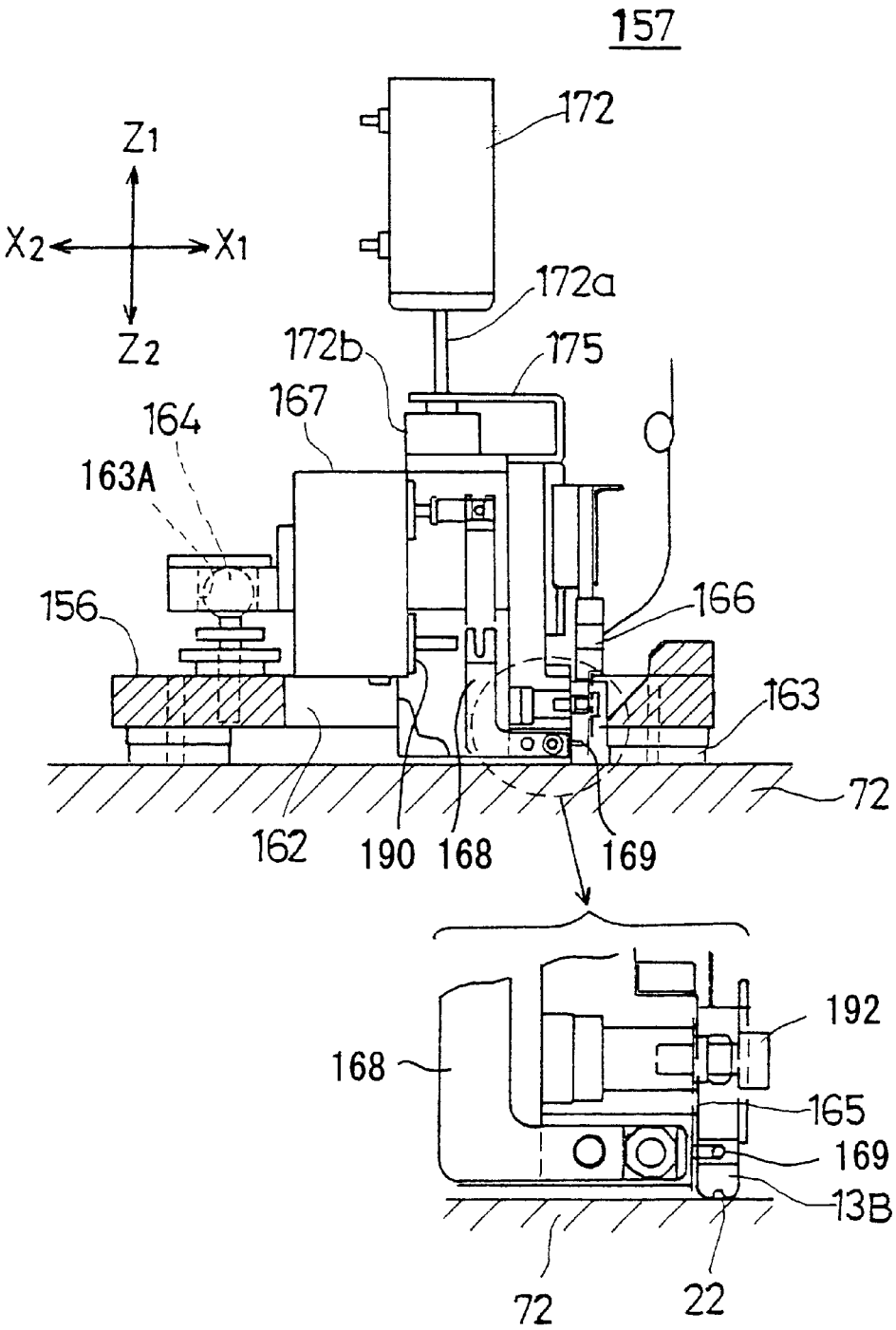
FIG. 14 shows a head unit.
Figure 15:
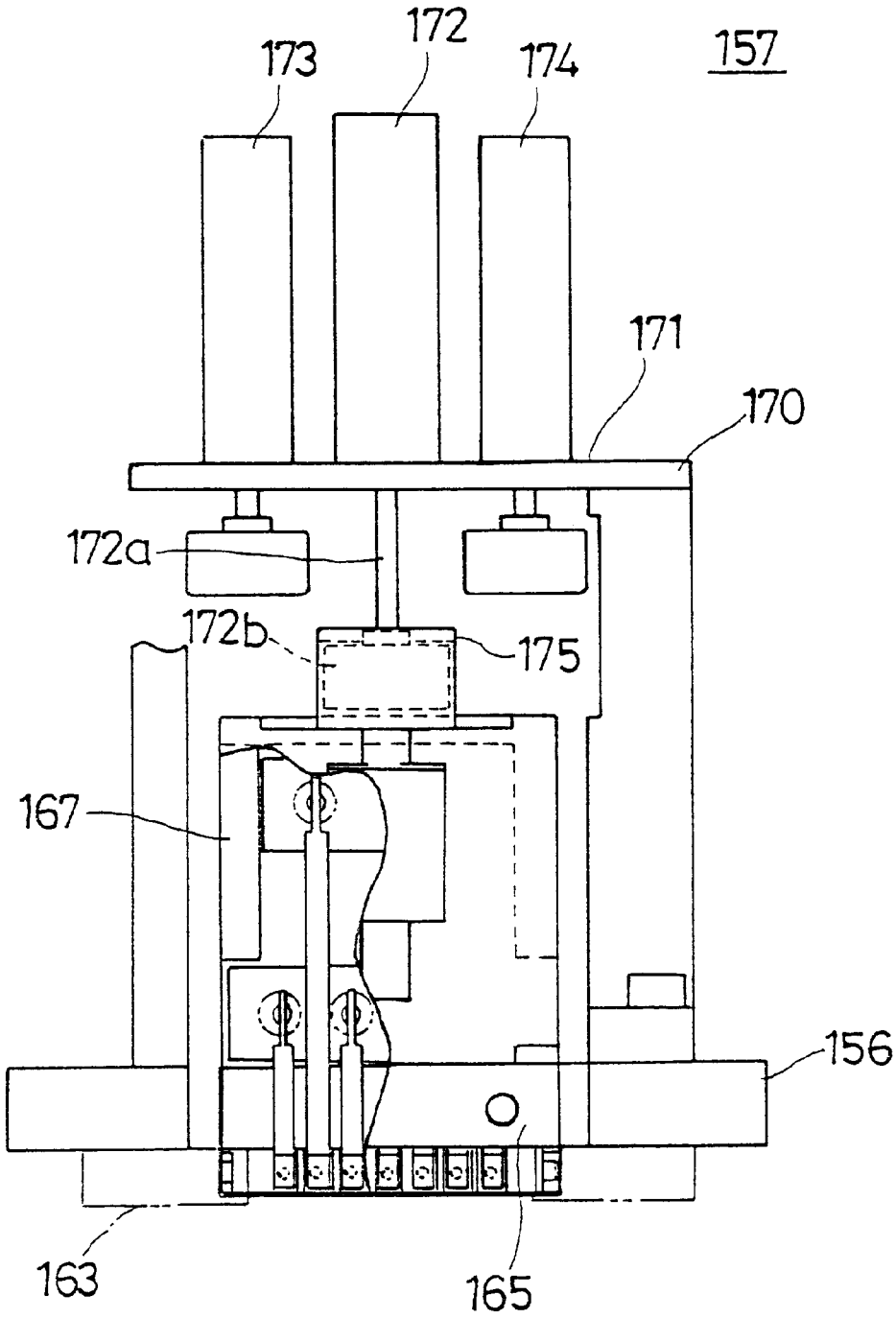
FIG. 15 shows the head unit as viewed from surface to which a transfer tool is attached.

FIG. 11 is a flow chart of the lapping process. FIG. 12 is a plan view of the lapping apparatus. FIG. 13 is a side view of the lapping apparatus. FIG. 14 shows a head unit. FIG. 15 shows the head unit as viewed from a surface to which a transfer tool is attached.

For clarity of explanation, a general description will be given of the lapping apparatus 60 as a whole followed by specific descriptions of particular parts thereof.

The lapping device 61 comprises a table base 70, a table 71 mounted on the table base 70, a rotary lapping plate 72, lapping units 73, 74, a ring 75 for spreading slurry supplied from a slurry supply unit 76 over an upper surface of the rotary lapping plate 72, a facing unit 77, and a wiper unit 78.

The rotary lapping plate 72 is positioned at a center of the table 71 and rotates in a direction indicated by arrow E in the diagram. The ring 75 rotates in a direction indicated by arrow F in the diagram. The lapping units 73, 74 are shown positioned laterally at a left side and a right side of the rotary lapping plate 72. The lapping units 73, 74 operate at the same time, so the lapping device 61 can lap more row bars than a device that has only one lapping unit. The slurry supply unit 76 that supplies slurry to an inner side of the ring 75, the facing unit 77 that dresses the rotary lapping plate 72, and the wiper unit 78 that wipes slurry off the rotary lapping plate 72 are positioned at a rear periphery of the rotary lapping plate 72.

The control unit 62, as shown in FIG. 10, comprises a computer 100 that uses appropriate control program software 101 and has a keyboard 102. The computer 100 is connected via an interface 103 to a lapping plate motor drive unit 104, a lapping unit motor drive circuit 105, a solenoid valve drive circuit 106, a resistance measurement circuit 107 and a wiper unit solenoid valve drive circuit 108.

Additionally, the lapping apparatus 60 is also provided with a server 110 that has information regarding the row bar 22 to be lapped as well as a high-pressure air source 111. The control unit 62 controls the pressure of the compressed air from the high-pressure air source 111 and sends it to the lapping device 61.

Lapping of the ground row bar 22 involves the operator mounting a transfer tool 30A to which the ground row bar 22 is attached to a bend unit 157 as shown in FIG. 14, connecting the connector to the terminals of the printed circuit board, and starting operation. Thereafter lapping is performed automatically and completed automatically, using the control software mentioned previously as well as row bar data i1 and setting parameters i2 supplied to the computer 100 via an interface 112, as shown in FIG. 11.

The lapping process itself consists of an anterior rough lapping stage and a posterior fine lapping stage, as shown in the flow chart in FIG. 11.

The rough lapping stage is performed according to the following steps.

Loading is carried out in a step S1. The lapping unit 73 is activated and a ground row bar 22 is lowered onto the rotary lapping plate 72. This operation eliminates human error in the contacting of the row bar 22 with the rotary lapping plate 72.

In a step S2, compressed air is blown out from a stopper, so as to keep the stopper floating slightly above the rotary lapping plate 72. The use of high-pressure air to float the stopper above the rotary lapping plate 72 reduces abrasion of the stopper.

In a step S3, pressure in the amount of approximately 2 $kgf/cm^2$ is applied to the lapping surface of the row bar 22.

In a step S4, slurry containing diamond powder is supplied. As described above, the slurry supply unit 76 supplies slurry to the inside of the ring 75 so as to spread the slurry over the upper surface of the rotary lapping plate. The slurry contains diamond powder having diamond particles ranging from ¼ to ⅛ $\mu$m in diameter.

In a step S5, the rotary lapping plate 72 is rotated at approximately 50 rpm.

In a step S6, a solenoid brake is turned OFF and the lapping unit 73 begins to oscillate in a single direction.

In a step S7, the solenoid brake is turned ON and the lapping unit 73 begins to oscillate in another direction as well, thus oscillating in two directions at once.

It should be noted that the row bar 22 is not in stable contact with the rotary lapping plate 72 at the beginning of the lapping operation, so the lapping unit 73 is moved in only a single direction in order to prevent the rotary lapping plate 72 from scratching the row bar 22.

It will be appreciated that lapping is carried out at high speed in steps 4, 5, 6 and 7.

In a step S8, it is determined whether or not the resistance MRh of the ELG elements 21 have attained a first setting value. If so, then the initial rough lapping stage is completed and the process continues to the fine lapping stage.

In a step S9, the slurry supply unit 76 supplies slurry containing no diamond powder to the interior of the ring 75, which spreads the powderless slurry across the upper surface of the rotary lapping plate 72.

In a step S10, the wiper unit 78 is lowered, contacting a wiper with the rotary lapping plate 72 and wiping the slurry away from the rotary lapping plate 72.

In a step S11, it is determined whether or not a predetermined period of time has elapsed since the beginning of step S10.

In a step S12, the wiper unit 78 is raised, thus readying the surface of the rotary lapping plate 72 for lapping.

In a step S13, it is determined whether or not the resistance MRh of the ELG elements 21 has attained a second setting value.

In a step S14, the air pressure is reduced, lowering the pressure exerted on the lapping surface of the row bar 22 to approximately 0.5 $kgf/cm^2$.

In a step S15, the speed with which the rotary lapping plate 72 is rotated is reduced to 15 rpm.

It will be appreciated that steps S9, S14 and S15 are intended to ensure more precise lapping of the row bar 22.

In a step S16, it is determined whether or not the resistance of the ELG elements 21 has attained a target value. If so, then the lapping unit 73 is activated and the lapped row bar 22 is raised from the surface of the rotary lapping plate 72, thus completing both the fine lapping stage as well as the entire lapping process.

It should be noted that it is also possible to eliminate step S3 and instead insert a similar step S18 just prior to step S17, in which compressed air is blown from the stopper. The blowing of compressed air from the stopper in step S18 separates the stopper from the rotary lapping plate 72 so that unloading can be carried out smoothly.

Additionally, it is possible to replace the step S11 (in which it is ascertained whether or not a predetermined period of time measured in seconds has elapsed) by ascertaining that the row bar 22 has been lapped a certain extent measured in $\mu$m.

A detailed description will now be given of individual components of the lapping apparatus 60, beginning with the lapping unit 73, with reference initially to FIGS. 12, 13, 20A and 20B.

Figure 20A:
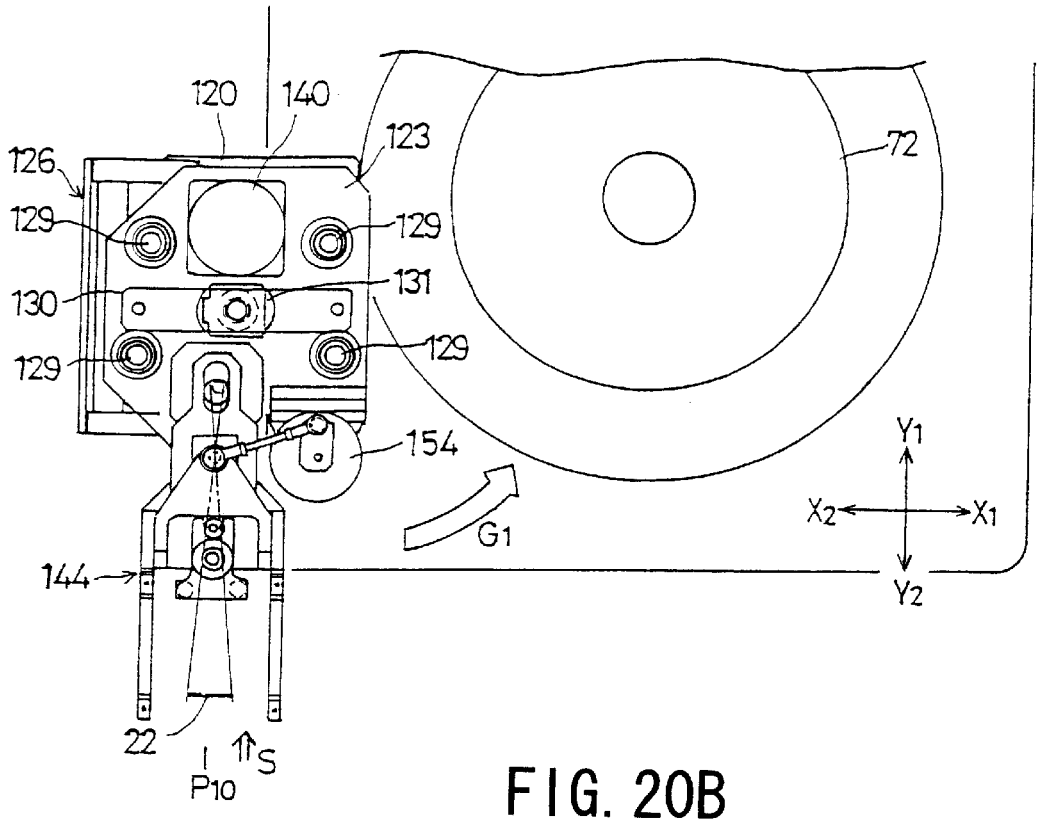
FIGS. 20A and 20B are diagrams illustrating a rotational segment of a loading operation.
Figure 20B:
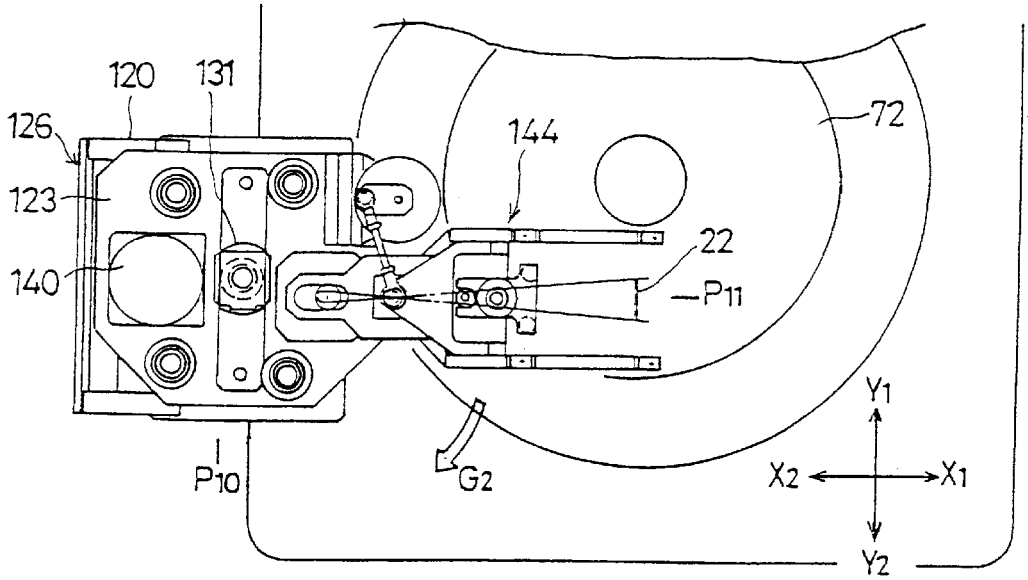

FIG. 12 is a plan view of the lapping apparatus. FIG. 13 is a side view of the lapping apparatus. FIGS. 20A and 20B are diagrams illustrating a rotational segment of a loading operation.

The lapping unit 73 comprises mainly a table 71, a base 120 fixedly mounted on the table 71, a swinging support plate 122 rotatably supported by a bearing 121 on the upper surface of the base 120, and a sub-base 123 that rises and descends on the upper surface of the swinging support plate 122. The swinging support plate 122 is rotated through an arc of 90 degrees between positions P10 and P11 along a perpendicular line 127 by a rotating mechanism 126 comprising a piston 124 and a rack-and-pinion assembly 125. The sub-base 123 rotates together with the swinging support plate 122 and is raised and lowered by a lift mechanism 128 while being guided by four guideposts 129. The lift mechanism 128 comprises, first, an inverted U-shaped member 130 whose bottom ends are mounted atop the swinging support plate 122 and which has a crossbar portion 130*a* positioned above the sub-base 123, and second, a piston 131 fixedly mounted atop the sub-base 123. The sub-base 123 is driven by the piston 131 so as to descend and rise between a lower position HL and an upper position HU.

A composite oscillation assembly 140 for oscillating the row bar 22 in multiple directions simultaneously is mounted atop the rising sub-base 123. The composite oscillation assembly 140 comprises a first oscillating mechanism 141 and a second oscillating mechanism 142.

The first oscillating mechanism 141 comprises an arm assembly 144 rotatably supported by a shaft 143 atop the sub-base 123, a motor 145 atop the sub-base 123, a first pulley 147 rotated by the motor 145 via the timing belt 146, and an eccentric cam 148 that rotates together with the first pulley 147 and engages a slot 144*a* in the arm assembly 144 that extends in an X2 direction from the shaft 143.

The arm assembly 144 has substantially the shape of a tuning fork when viewed from above or below and, as can be seen in FIG. 13, a substantially Z-shaped outline when viewed from the side, such that a portion of the arm assembly 144 extending in an X1 direction is lower than a portion of the arm assembly 144 extending in the opposite X2 direction, with two parallel arms 144*b*, 144*c*. A fully ground row bar 22 is thus mounted at the X1 end of the arm assembly 144 as shown in FIG. 12.

Figure 16:
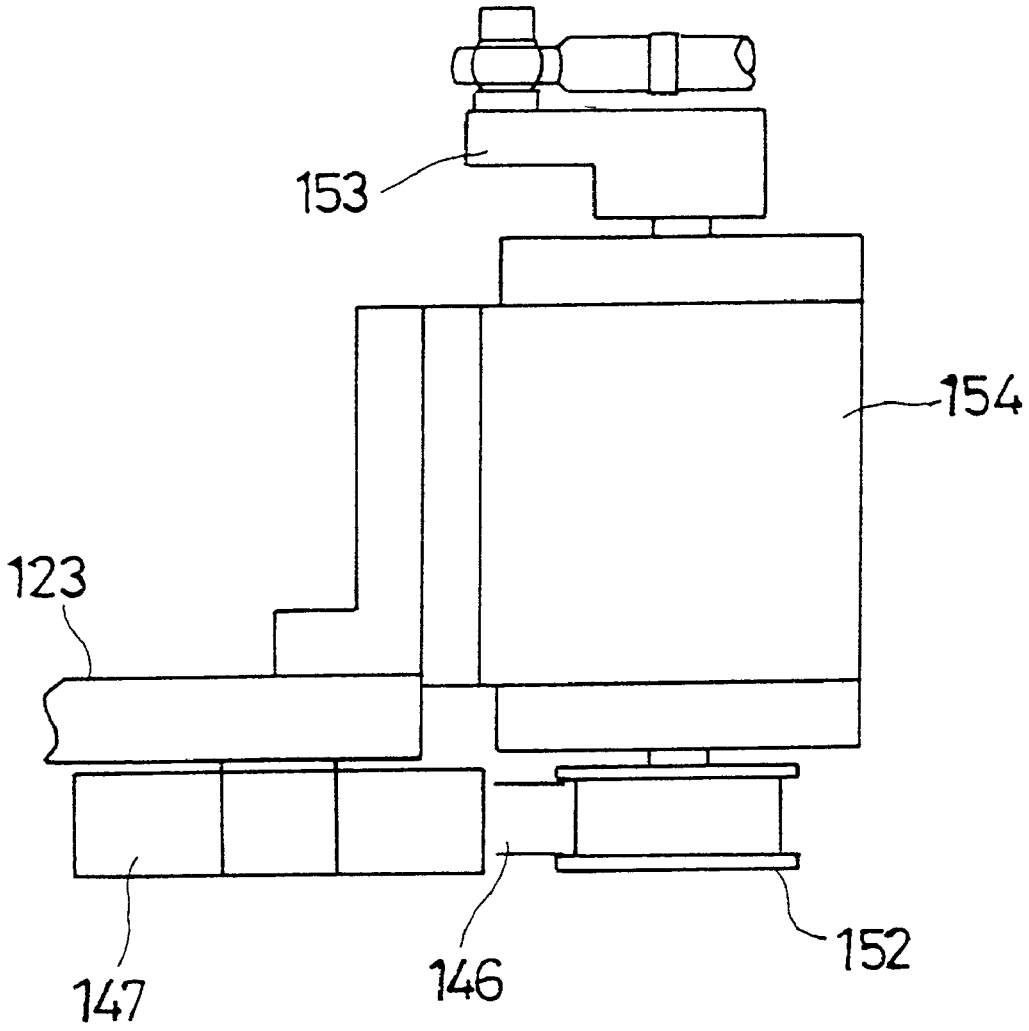
FIG. 16 is a schematic view of a structure of a portion in the vicinity of the rotary arm shown in FIG. 12.

The second oscillating mechanism 142 comprises a guide rai1 150 mounted between the arms 144*b*, 144*c* of the arm assembly 144 and a sliding structure 151 that straddles the guide rai1 150 and is slidably supported by the guide rai1 150. Additionally, as can be seen in FIG. 16, which is a schematic view of a structure of a portion of the composite oscillation assembly 140 in the vicinity of the rotary arm shown in FIG. 12, the second oscillating mechanism 142 comprises a second pulley 152 supported by the sub-base 123 and engaged by the timing belt 146, a rotary arm 153 coaxial with the second pulley 152, a solenoid clutch 154 located between the second pulley 152 and the rotary arm 153, a link 155 that connects the rotary arm 153 and a Y2 edge of the sliding structure 151, a supporting frame member 156 shown most clearly in FIGS. 17A and 17B, which are rear views of a supporting frame member and a cross-sectional view along a line B—B thereof, respectively, and a bend unit 157 most clearly seen in FIG. 14, which shows a head unit, and in FIG. 15, which shows the head unit as viewed from a surface to which a transfer tool is typically attached.

As shown in FIG. 12, the guide rai1 150 is disposed along an arc having a radius R and a center 01 at a position at which the ground row bar 22 is mounted.

Figure 18:
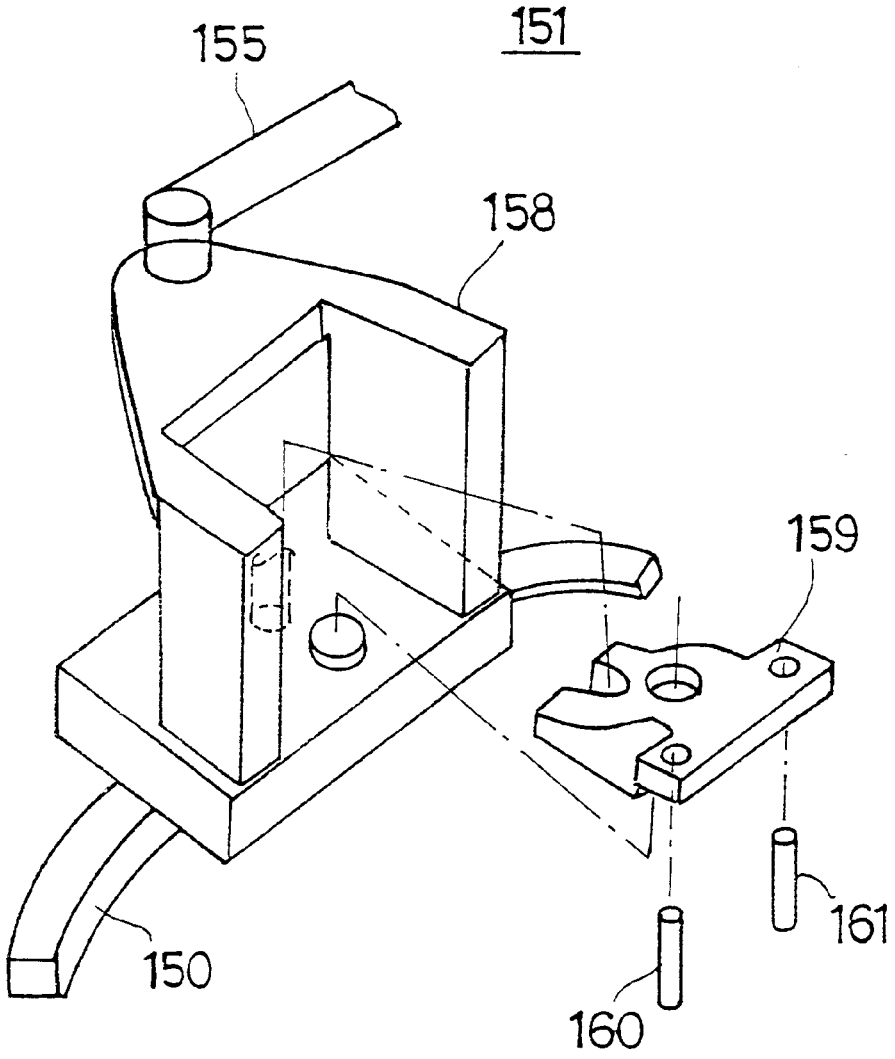
FIG. 18 is a perspective view of a slide structure.

FIG. 18 shows a perspective view of the sliding structure 151. As shown in the drawing, the sliding structure 151 consists of a body 158 and a connecting member 159 engagedly mounted on the body 158.

Figure 17A:
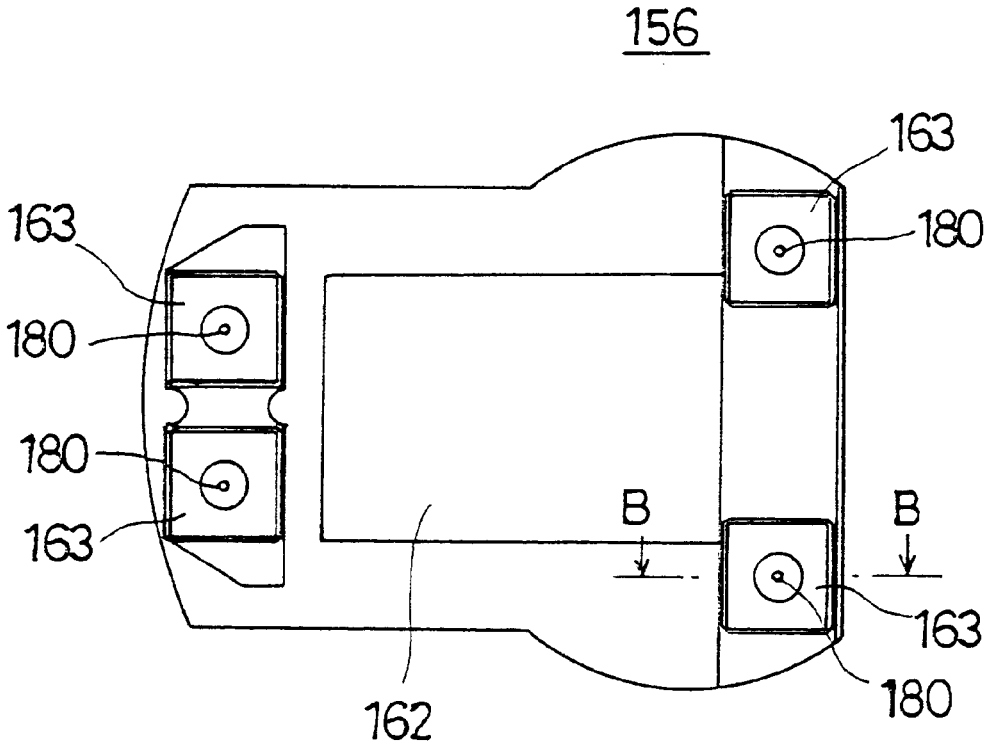
FIGS. 17A and 17B are rear views of a supporting frame member and a cross-sectional view along a line B—B thereof, respectively.
Figure 17B:
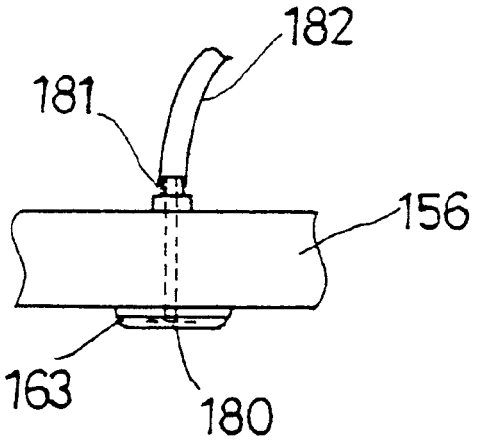

As shown in FIGS. 17A and 17B, the supporting frame member 156 is substantially rectangular in shape, with a central opening 162. The supporting frame member 156 is connected to the connecting member 159 by two pins 160, 161 at an X1 edge of the supporting frame member 156, as indicated in FIG. 13. As shown in FIG. 17A, four ceramic stoppers 163 are distributed along a bottom surface of the supporting frame member 156. As described above, the ceramic stoppers 163 slide over the upper surface of the rotary lapping plate 72. As shown in FIG. 17B, each stopper has an aperture 180 through which compressed air is blown. An upper side of the aperture 180 is provided with a tube fitting 181 to which a tube 182 is connected. The tube 182 has an external diameter of 1.3 mm and an internal diameter of 0.55 mm, which is substantially narrower than conventional such tubes, and is made of a material containing carbon in order to reduce the effects of static electricity build-up.

Figure 19A:
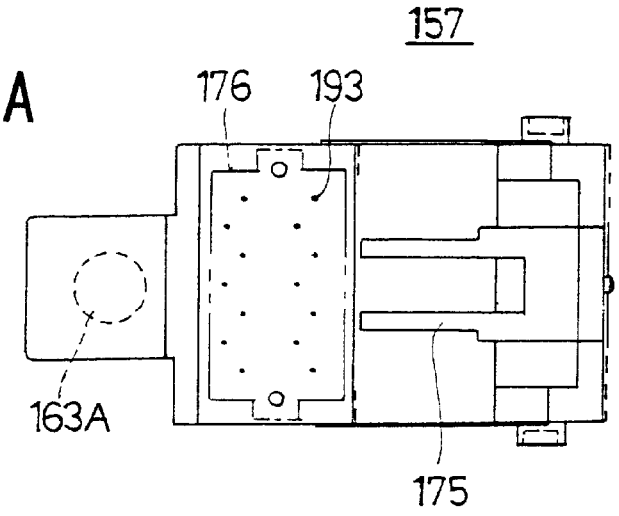
FIGS. 19A and 19B show plan and partial exploded views of the head unit, respectively.
Figure 19B:
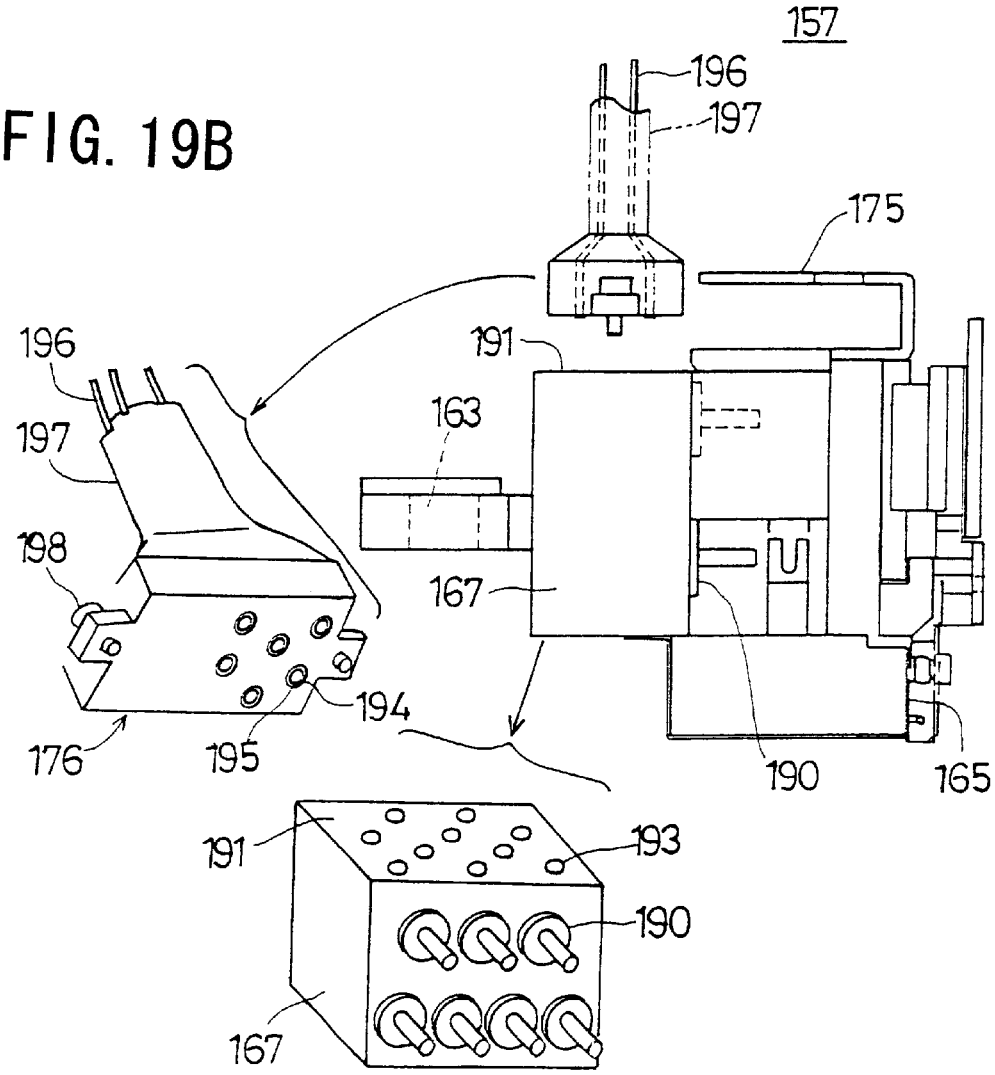

The bend unit 157, as shown in FIGS. 14 and 15 as well as FIGS. 19A and 19B, which show plan and partial exploded views of the head unit, respectively, comprises a bearing concavity 163A that engages a ball bearing 164 provided atop the supporting frame member 156 and housed inside the central opening 162 in the supporting frame member 156 described above. The bend unit 157 further comprises a transfer tool mounting portion 165 and a connector 166 provided on an X1 edge of the bend unit 157 as well as (on a central portion of the bend unit 157) a piston module 167 composed of a plurality of pistons 190 and links 168 pressed by each of the pistons 190. Each link 168 is provided with a finger portion 169 on an X1 edge of the link 168. Each one of the finger portions 169 engages a bend hole 30A formed in the transfer tool 30A to be described later.

Additionally, as shown in FIG. 15, an inverted U-shaped frame 170 is fixedly mounted atop the supporting frame member 156 so as to straddle the bend unit 157. The frame 170 has a crossbar portion 171, atop a central portion of which are mounted a central piston 172 and additional pistons 173 and 174 along either lateral side of the central piston 172. A rod 172*a* extends downward from the central piston 172, with a circular disk 172*b* attached to a lower tip of the piston rod 172*a*. As shown in FIG. 15, the disk 172*b* engages a head unit bracket 175.

As shown in FIG. 19B, an air supply connector 176 is connected to the piston module 167. Ports 193 that accommodate the rods of the pistons 190 are formed in a flat upper surface 191 of the piston module 167, and ports 194 corresponding to the ports 193 in the piston module 167 are formed in the air supply connector 176. Each of the air supply connector ports 194 is surrounded by an O-ring 195 to provide an airtight seal, while one tube 196 is connected to each one of the ports 194. The plurality of tubes 196 extending from the air supply connector 176 are contained within a protective guide hose 197. The entire air supply connector 176 is mounted to the upper surface 191 of the piston module 167 and in this mounted state each of the tubes 196 is connected to each one of the ports 193 in the piston module 167. The tubes 196 are of the same type as the tubes 182 described above.

It will be appreciated that the above-described structure simplifies the task of servicing the piston module 167. Specifically, in order to service the piston module 167 the screws 198 are first removed and the air supply connector 176 is removed, thus permitting direct access to the piston module 167. Simply reattaching the air supply connector 176 and refastening the screws 198 connects all the ports 193 to an air supply.

Additionally, the tubes 196 are narrower than is conventionally the case as described above, so the protective guide hose 197 can also be made narrower as well and thus requires less space. Moreover, the narrowness of the tubes makes them less rigid than is conventionally the case and so a relatively small force is exerted on the bend unit 157 and the bend unit 157 is not unbalanced thereby, thus improving lapping precision.

A description will now be given of an operation of the lapping unit 73, with reference initially to FIGS. 21A, 21B and 22.

Figure 21A:
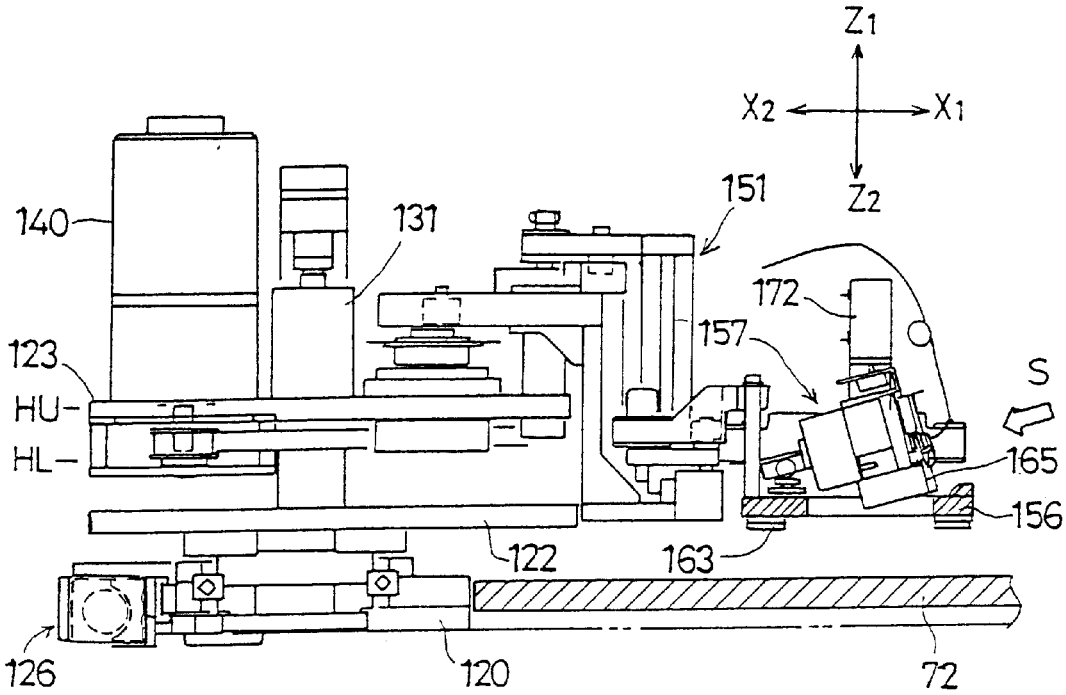
FIGS. 21A and 21B are diagrams illustrating a raising segment of the loading operation.
Figure 21B:
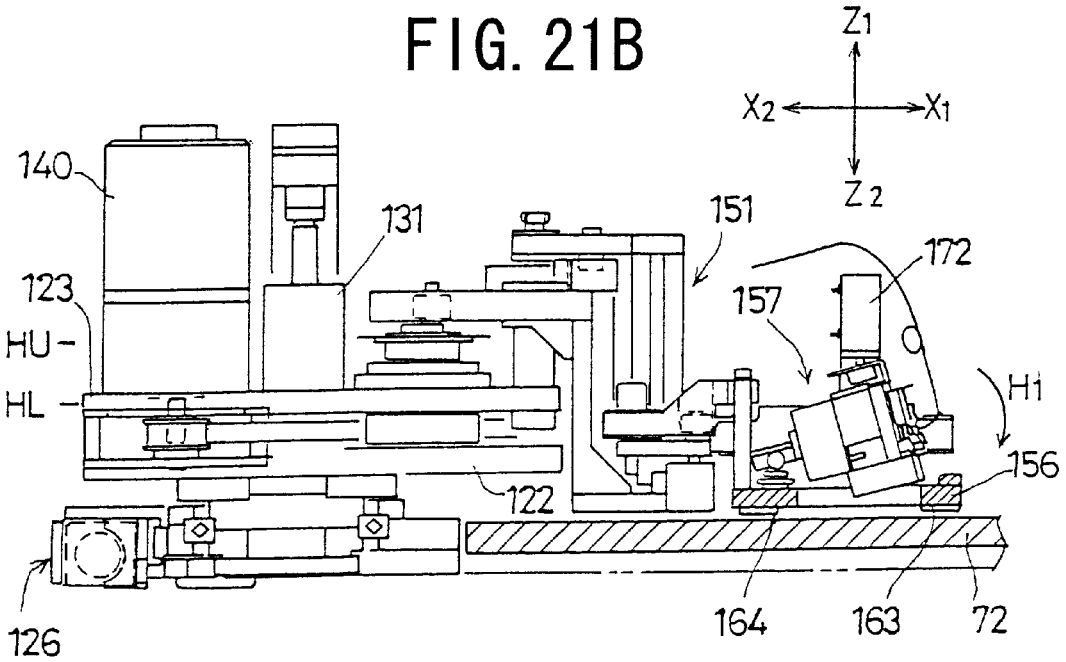

FIGS. 21A and 21B are diagrams illustrating a raising segment of the loading operation. FIG. 22 is a lapped row bar attached to a transfer tool.

1. Mounting the Transfer Tool 30A

Figure 22:
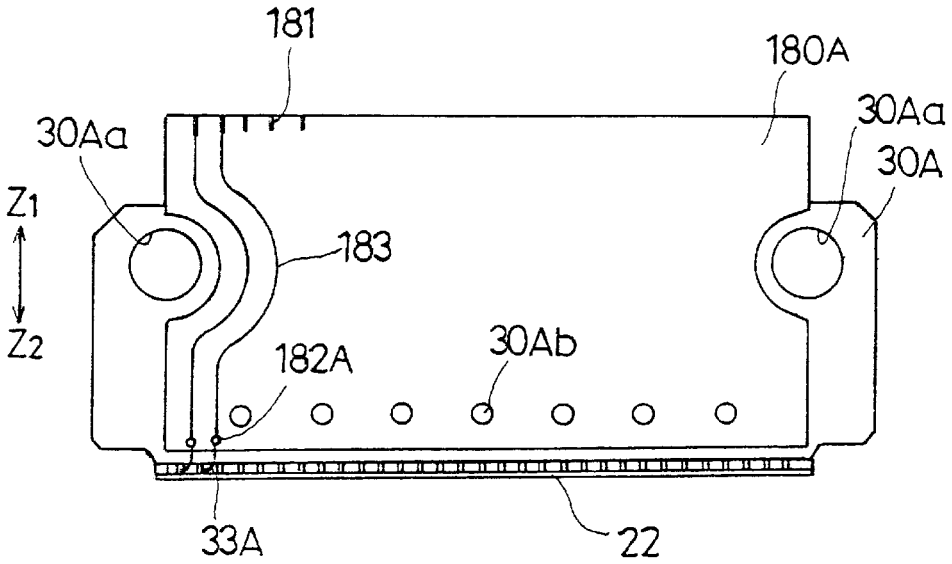
FIG. 22 shows a ground row bar attached to a transfer tool.

As shown in FIG. 22, the transfer tool 30A is provided with two mounting holes 30Aa as well as a plurality of bend holes 30Ab. A printed circuit board 180A is fixedly mounted on a top surface of the transfer tool 30A. A Z1 side of the printed circuit board 180A extends beyond a Z1 edge of the transfer tool 30A. Terminals 181 are aligned along the Z1 edge of the printed circuit board and pads 182A are aligned along a Z2 edge of the printed circuit board as shown in the drawing, with a printed wiring pattern formed between the terminals 181 and the pads 182A.

The ground row bar 22 is attached to the transfer tool 30A along a Z2 edge of the transfer tool 30A using wax. Additionally, wires 33A are bonded to the row bar 22 ELG elements 21 and the pads 182A described above so as to electrically connect the ELG elements 21 to the printed circuit board 180A.

In order to mount the transfer tool 30A, the arm assembly 144 of the lapping unit 73 is facing the Y2 direction as shown in FIG. 20A, the ascending base 123 is raised in a vertical Z1 direction to position HU as shown in FIG. 21A and the bend unit 157 is lifted at an angle by the central piston 172, such that the transfer tool mounting portion 165 projects upwardly from the supporting frame member 156 as shown in FIGS. 21A and 21B.

As shown in FIG. 14, the transfer tool 30A is mounted on the transfer tool mounting portion 165 by threading screws 192 through screw holes 30Aa and into the bend unit 157. The transfer tool 30A mounting portion 165 projects upwardly from the supporting frame member 156 and is exposed at an angle thereto, facilitating attachment of the transfer tool 30A by permitting the transfer tool 30A to be mounted from a direction indicated in FIG. 21A by arrow S, that is, at an angle with respect to the plane of the rotary lapping plate 72.

Additionally, at this time each of the plurality of bend holes 30Ab engages finger portions 169. The connector 166 is lowered manually and connected to the Z1 side of the printed circuit board 180A.

The operations described below are performed automatically by the computer 100 loaded with the control program software 101 described above.

2. The Loading Operation

Figure 23:
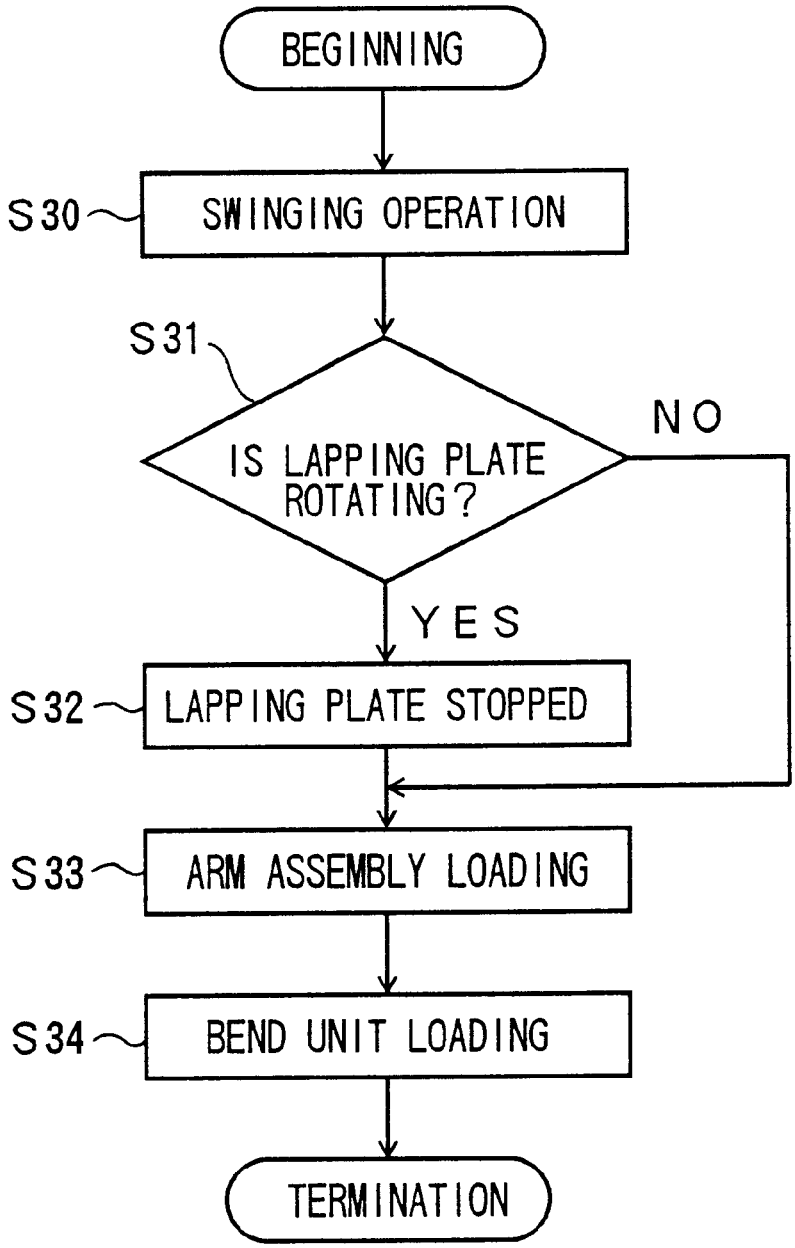
FIG. 23 is a flow chart of a loading operation.

FIG. 23 is a flow chart showing steps in the loading operation, shown in FIG. 11 as step S1.

First, a swinging operation is carried out in a step S30. In this step S30, the piston 124 is activated and the swinging support plate 122 as well as the sub-base 123 are swung 90 degrees in a direction indicated by arrow G1 in FIG. 20A, achieving the state shown in FIG. 21A with the bend unit 157 poised above the rotary lapping plate 72.

Then, in a step S31 and a step S32, it is ascertained whether or not the rotary lapping plate 72 is rotating and, if so, the rotation of the rotary lapping plate 72 is stopped.

Next, in a step S33, the arm assembly 144 is loaded. Specifically, the piston 131 is activated, the sub-base 123 is lowered guided by the four guideposts 129 and the arm assembly 144 lowered to achieve the state shown in FIG. 21B, such that the stoppers 163 contact the upper surface of the rotary lapping plate 72.

Finally, in a step S34, the bend unit 157 is loaded. Specifically, the central piston 172 is activated and the bend unit 157 is lowered while rotating in a direction indicated by arrow H1 about the ball bearing 164, thus placing the ground row bar 22 into contact with the upper surface of the rotary lapping plate 72 as shown in FIGS. 13 and 14.

The bend unit 157 is supported along its X1 side by the ball bearing 164 and is supported along its X2 side by the ground row bar 22 now in contact with the upper surface of the rotary lapping plate 72, so the bend unit 157 is stably supported along a Y1-Y2 axial direction through a length c shown in FIG. 12. At this point, a longitudinal axis of the ground row bar 22 is aligned along the radial direction of the rotary lapping plate 72.

Figure 24:
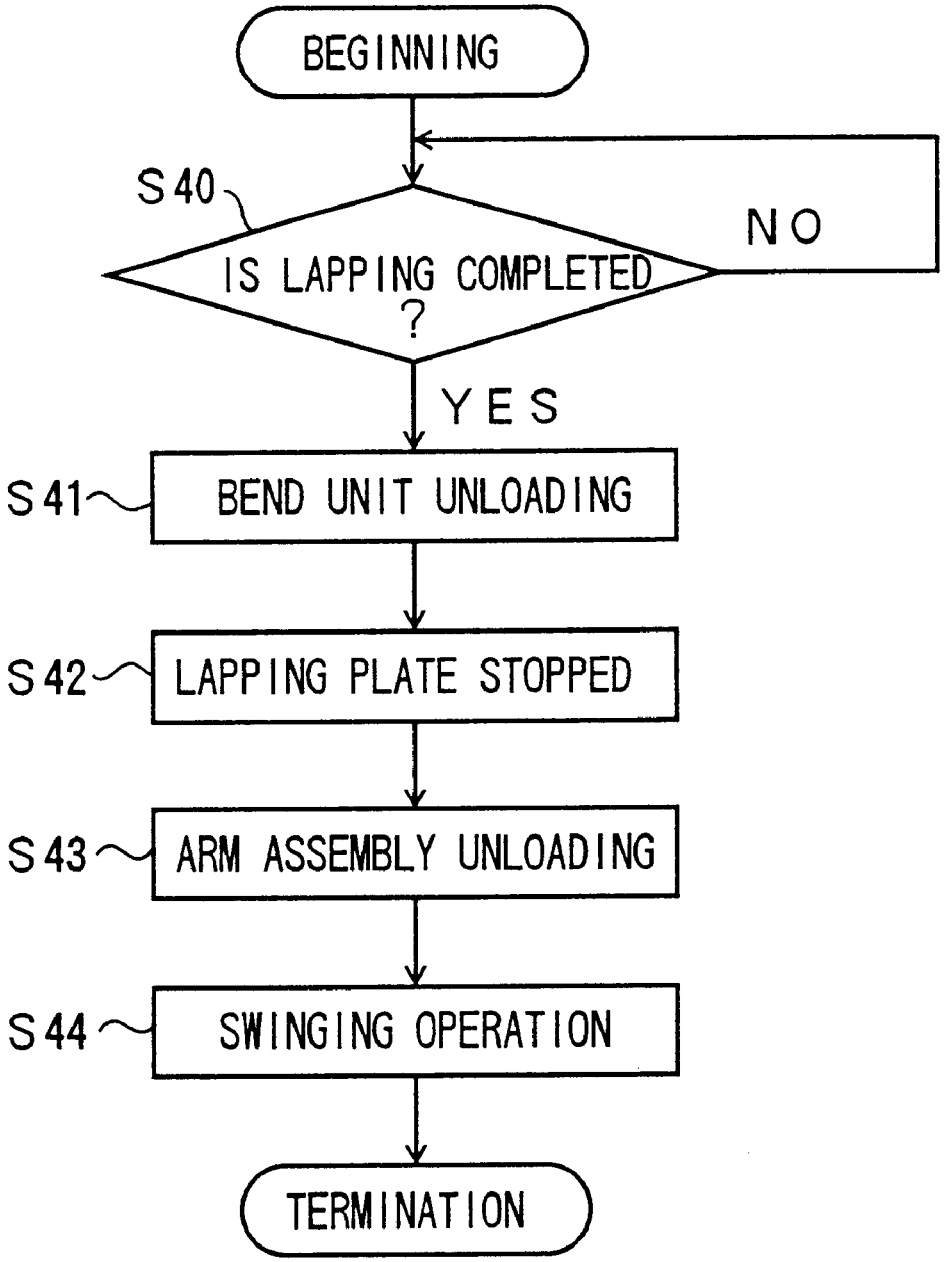
FIG. 24 is a flow chart of an unloading operation.

An unloading operation (given as step S17 in FIG. 11), in which the finished row bar 22 is separated from the upper surface of the rotary lapping plate 72, is the reverse of the steps described above as shown in FIG. 24. FIG. 24 is a flow chart of the unloading operation, showing that the unloading operation commences when lapping is ascertained to be completed in a step S40, after which the bend unit 157 is raised in a step S41, the rotation of the rotary lapping plate 72 is stopped in a step S42, the sub-base 123 and the arm assembly 144 are raised in a step S43, and the swinging support plate 122 is swung in a direction indicated by arrow G2 in FIG. 20B in a step S44.

It will be appreciated that the loading operation and the unloading operation described above are performed without the intervention of a human operator. Accordingly, the operations of bringing the ground row bar 22 into contact with the upper surface of the rotary lapping plate 72 and of separating the lapped row bar 22 from the upper surface of the rotary lapping plate 72 are carried out with a precision not dependent upon the skill of the operator. As a result, the row bar 22 can be loaded and unloaded without scratching the lapped surface of the row bar 22.

Additionally, after unloading is completed, the stoppers 163 are also separated from the upper surface of the rotary lapping plate 72, thus reducing wear on the stoppers compared to the conventional arrangement.

3. Combined Oscillation of the Row Bar 22

Oscillation of the row bar 22 in more than one direction at the same time, shown as step S7 in FIG. 11, involves turning the solenoid clutch 154 ON, thus activating the motor 145, rotating the eccentric cam 148 by the timing belt 146 so as to activate the first oscillating mechanism 141, and further, rotating the rotary arm 153 by the same timing belt 146 so as to activate the second oscillating mechanism 142.

Figure 25:
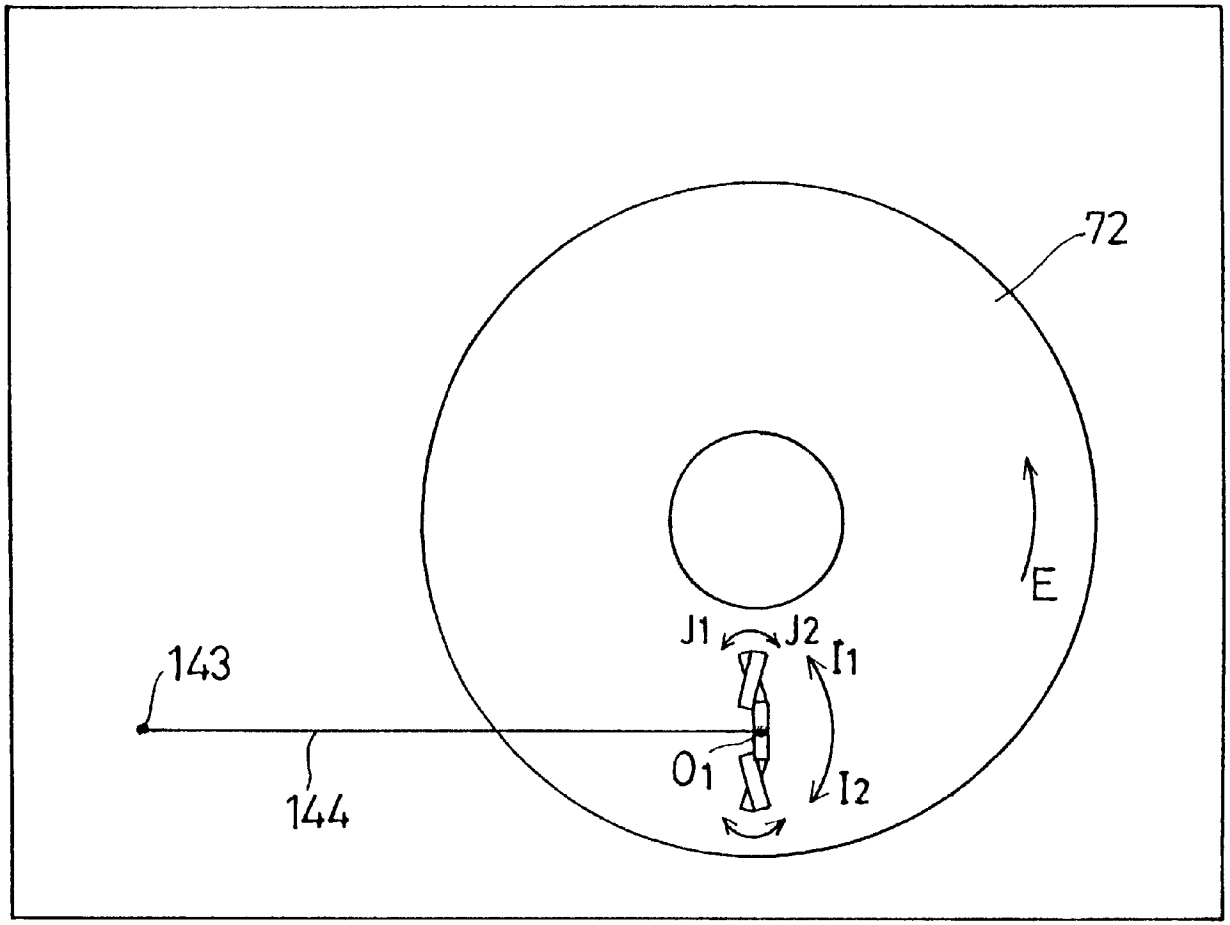
FIG. 25 is a schematic diagram showing the combined movement of the row bar across a rotary lapping plate.

FIG. 25 is a schematic diagram showing the combined movement of the row bar across the rotary lapping plate.

The rotation of the eccentric cam 148 within the slot 144*a* in the arm assembly 144 causes the arm assembly 144 to oscillate or swing about the shaft 143 in directions indicated by arrows I1 and I2 as shown in FIG. 25. The bend unit 157 at the tip of the arm assembly 144 also moves together with the arm assembly 144, thus swinging the row bar 22 in the I1-I2 direction, that is, in the radial direction of the rotary lapping plate 72, which radial direction is also in the longitudinal direction of the row bar 22.

The rotation of the rotary arm 153 causes the sliding structure 151 to maintain a constant attitude with respect to the arc-like guide rai1 150 via the link 155, thus sliding the sliding structure 151 along the arc formed by the guide rai1 150. The bend unit 157 moves with the sliding structure 151 about the X2 side thereof. The row bar 22 swings repeatedly about a longitudinal central point 01 of the row bar 22 in directions indicated by arrows J1-J2 in FIG. 25.

Figure 26:
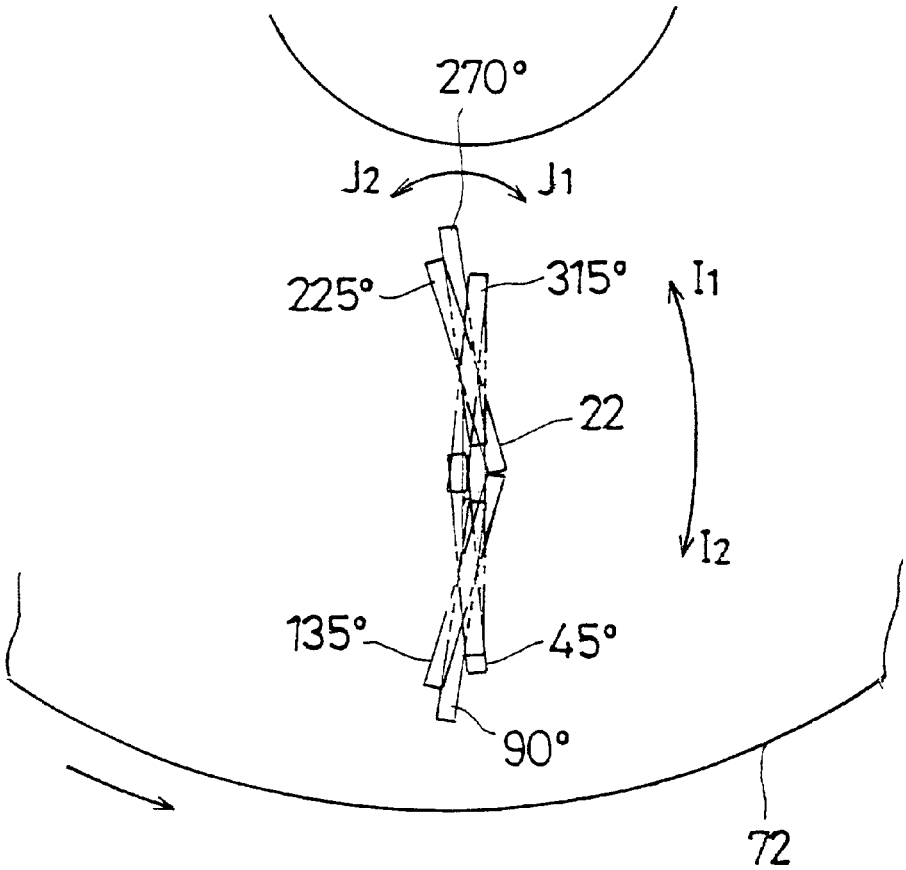
FIG. 26 is a diagram showing the combined movement of the row bar across the upper surface of the rotary lapping plate.

FIG. 26 is a diagram showing the combined movement of the row bar across the upper surface of the rotary lapping plate. As a result of the actions described above, the row bar 22 is oscillated repeatedly about the shaft 143 in the I1-I2 direction while being oscillated in the J1-J2 direction about the central point 01 by the operation of the second oscillating mechanism, as shown in FIG. 26.

A description will now be given of the relation between the oscillation of the row bar 22 in the I1-I2 direction and oscillation of the row bar 22 in the J1-J2 direction.

Figure 27:
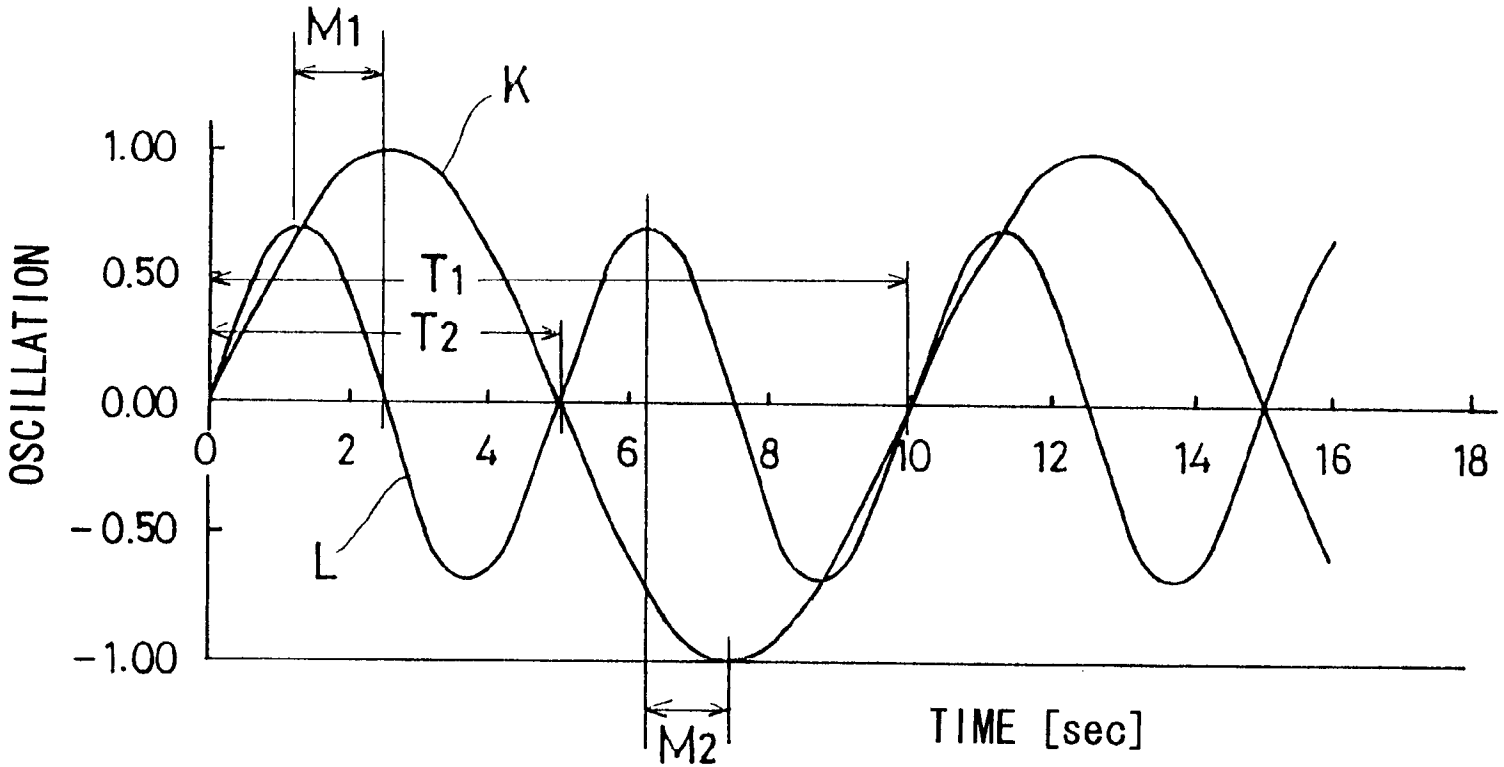
FIG. 27 is a graph showing a relation between oscillation of the row bar in a direction I1-I2 and oscillation of the row bar in a direction J1-J2.

FIG. 27 is a graph showing a relation between oscillation of the row bar 22 in the direction I1-I2 and oscillation of the row bar 22 in the direction J1-J2.

It should be noted that a diameter d1 of the pulley 147 is approximately twice that of a diameter d2 of the pulley 152.

Accordingly, when, for example, the rotational speed of the eccentric cam 148 is 6 rpm, the rotational speed of the rotary arm 153 is 12 rpm.

Accordingly, the oscillation of the row bar 22 in the I1-I2 direction shows a periodicity indicated by a line K in FIG. 27. Similarly, the oscillation of the row bar 22 in the J1-J2 direction shows a periodicity indicated by a line L in FIG. 27. As can be seen from FIG. 27, a period T2 of a cycle of the oscillation of the row bar 22 in the J1-J2 direction is approximately one half a period T1 of a cycle of the oscillation of the row bar 22 in the I1-I2 direction.

Accordingly, since the periods of the two oscillations differ by an amount of time indicated in the drawing as M1 and M2, the row bar 22 does not remain motionless when reaching an end of a stroke in one direction, for example the I1-I2 direction, but is still oscillating in the other direction, here J1-J2. Thus, the row bar 22 is always moving.

As a result, the row bar 22 may be separated from the rotary lapping plate 72 at any time without fear of scratching the lapped surface of the row bar 22. Accordingly, the unloading operation of step S17 in FIG. 11 can be performed as soon as it is determined in the step S16 that the resistance MRh of the ELG elements 21 have attained the target value regardless of the position of the row bar 22 on the rotary lapping plate 72 at that time, without the need to wait for the row bar 22 to reach a predetermined unloading position as is the case with the conventional art. This ability to remove the row bar 22 from contact with the rotary lapping plate 72 prevents unnecessary additional lapping of the row bar 22 and thus improves the precision with which the row bar 22 can be lapped.

FIG. 26 shows a relation between an angle of the eccentric cam 148 when rotated counter-clockwise taking the position shown in FIG. 12 as 0° and the compound multidirectional movement of the row bar 22 described above. The angular values given each of the row bars 22 indicate the rotational angle of the eccentric cam 148 when the row bars 22 reach the positions indicated in the drawing.

Additionally, the simultaneous movement of the row bar 22 in multiple directions described above provides a better, that is, more finely lapped, surface than is the case with the conventional art.

4. Blowing Compressed Air from the Stoppers

The operation of blowing compressed air through the stoppers, shown as step S2 of FIG. 11, involves the structure shown in FIG. 17B, with compressed air being supplied through the tube 182, led through the aperture 180 and onto the upper surface of the rotary lapping plate 72. The operation of blowing compressed air through the stoppers 163 causes the stoppers 163 to float slightly above the upper surface of the rotary lapping plate 72.

As a result, the compound multidirectional movement of the bend unit 157 takes place under conditions in which the stoppers 163 contact the upper surface of the rotary lapping plate 72 in a state of reduced frictional contact, with the following two advantages.

First, wear on the stoppers 163 is reduced, the support frame member 156 is maintained on the level during lapping and the bend unit 157 also is maintained in its original state, for more precise lapping.

Second, during lapping the support frame member 156 does not shake due to changes in the frictional force of the stoppers 163 on the upper surface of the rotary lapping plate 72, so lapping can be carried out more precisely.

Additionally, the stoppers 163 float slightly off the upper surface of the rotary lapping plate 72, so lapping continues unaffected by either the flatness of the upper surface of the rotary lapping plate 72 or the volume of slurry spread across the surface of the upper surface of the rotary lapping plate 72.

Additionally, because the stoppers are not suctionally attached to the upper surface of the rotary lapping plate 72, the unloading operation of the step S17 shown in FIG. 11 can be performed smoothly with a minimum of force, which means that the central piston 172 may be relatively small and yet still adequate to the task of unloading. Moreover, because the stoppers 163 are not suctionally attached to the upper surface of the rotary lapping plate 72, the bend unit 157 is not tilted in either the Y1 or the Y2 direction when the central piston 172 is activated and the X2 side of the bend unit 157 is lifted, thus avoiding scratching of the rotary lapping plate 72.

It should be noted that the operations of steps S3 and S14 of FIG. 11 are carried out by changing the pressure of the compressed air supplied to the central piston 172.

Additionally, it should be noted that the operation of the step S18 of FIG. 11 is accomplished using the structure shown in FIG. 17B. That is, immediately after the step S16, in which it is ascertained whether or not the resistance of the ELG elements 21 has attained a target value, a blast of compressed air is supplied through the tube 182 and blown out of the aperture 180 in each one of the stoppers 163 against the upper surface of the rotary lapping plate 72. By so doing, the unloading operation of the step S17 can be carried out smoothly and with a minimum of force, without fearing of scratching the rotary lapping plate 72.

Additionally, as described above, the tubes 182 are relatively narrow compared to the conventional art, so the tubes 182 are not rigid but bend easily, have little repulsive force and thus do not affect the positioning and stability of the supporting frame member 156.

5. Operations According to Steps S8, S11 and S13

The ELG elements 21 on the row bar 22 are connected to the resistance measurement circuit 107 shown in FIG. 10 via the wire 33A, the printed circuit board 180A and the connector 166. The operations of steps S8, S13 and S16 are carried out by the resistance measurement circuit 107 constantly comparing the resistance value MRh to the setting values and the target value.

Lapping is conducted by constantly monitoring the resistance MRh of the ELG elements 21 and adjusting the pistons 190 of the piston module 167 according to the ELG elements 21 resistance value MRh obtained by such monitoring. The finger portions 169 contact inner walls on bottoms of each of the plurality of bend holes 30Ab via links 168 to bend the transfer tool 30A as appropriate and thus bend the row bar 22 as appropriate, so that the magnetoresistive film of all the magnetoresistive head elements attains a uniform target thickness.

A detailed description will now be given of the wiper unit mentioned above, with reference to FIGS. 28, 29, 30, 31 and 32.

Figure 28:
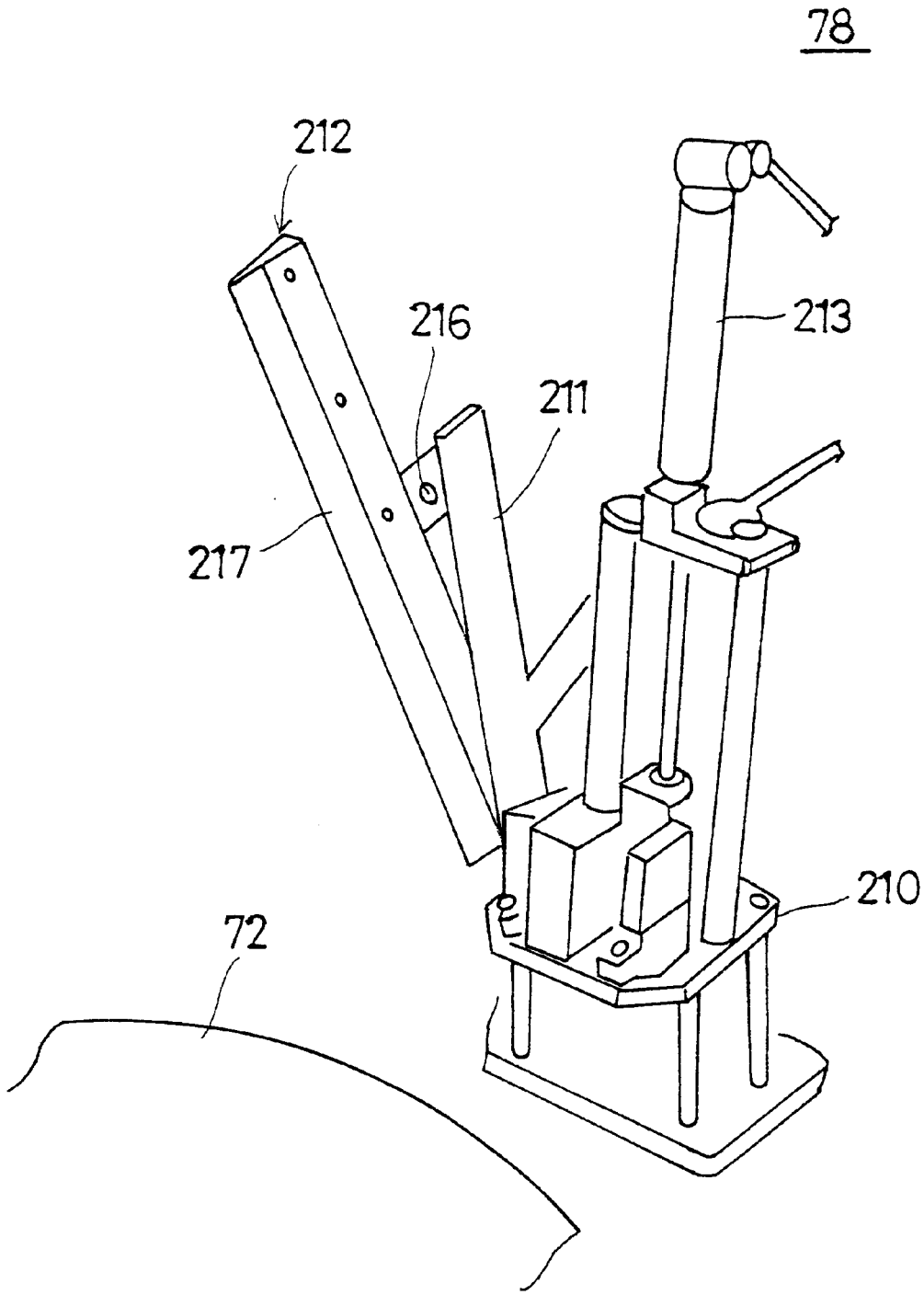
FIG. 28 is a perspective view of a wiper unit.
Figure 29:
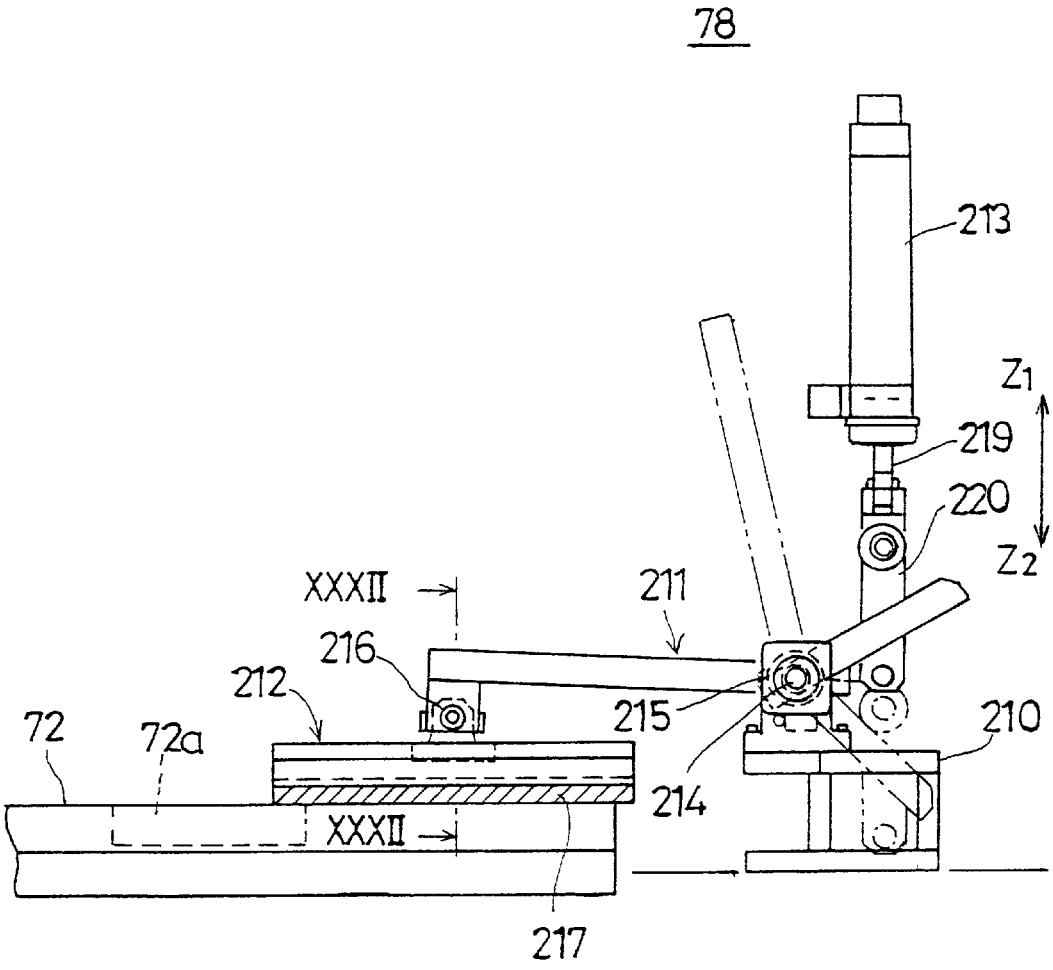
FIG. 29 is a front view of the wiper unit.
Figure 30:
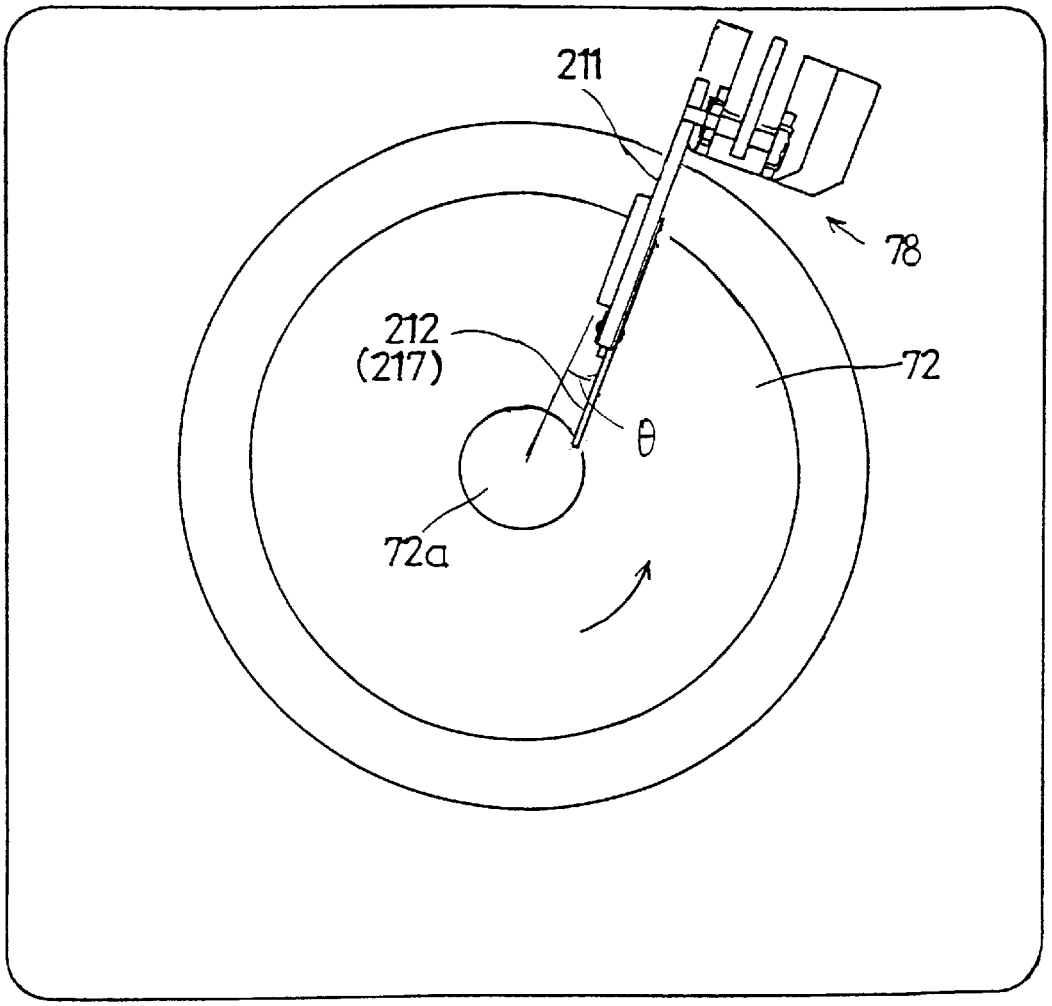
FIG. 30 is a plan view of the wiper unit.
Figure 31:
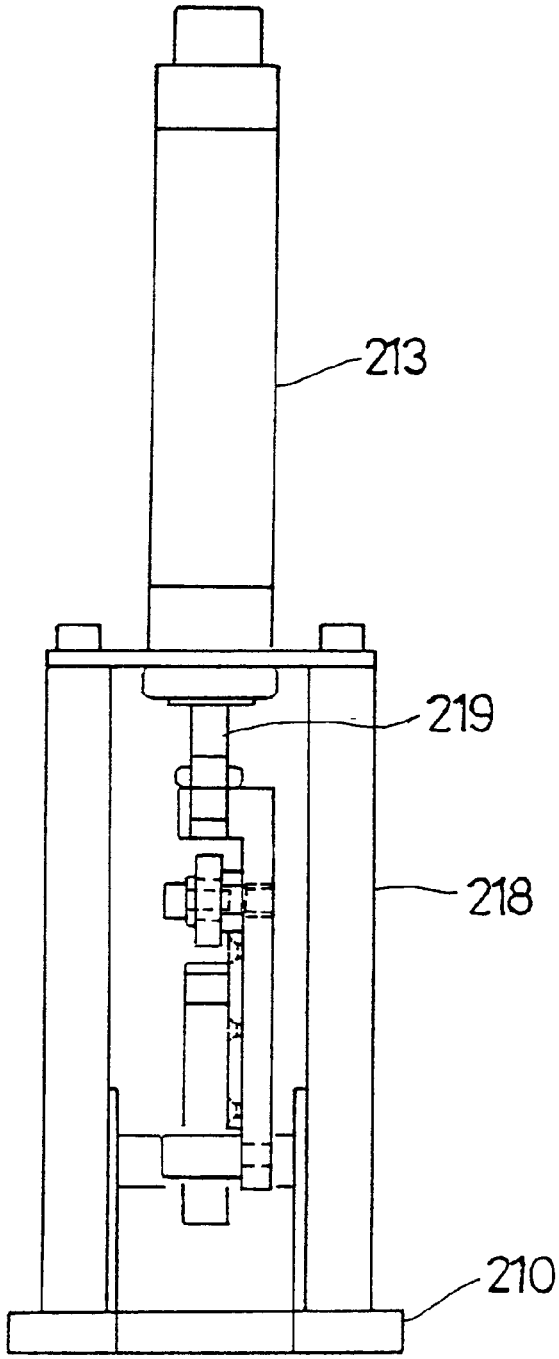
FIG. 31 is a side view of the wiper unit.
Figure 32:
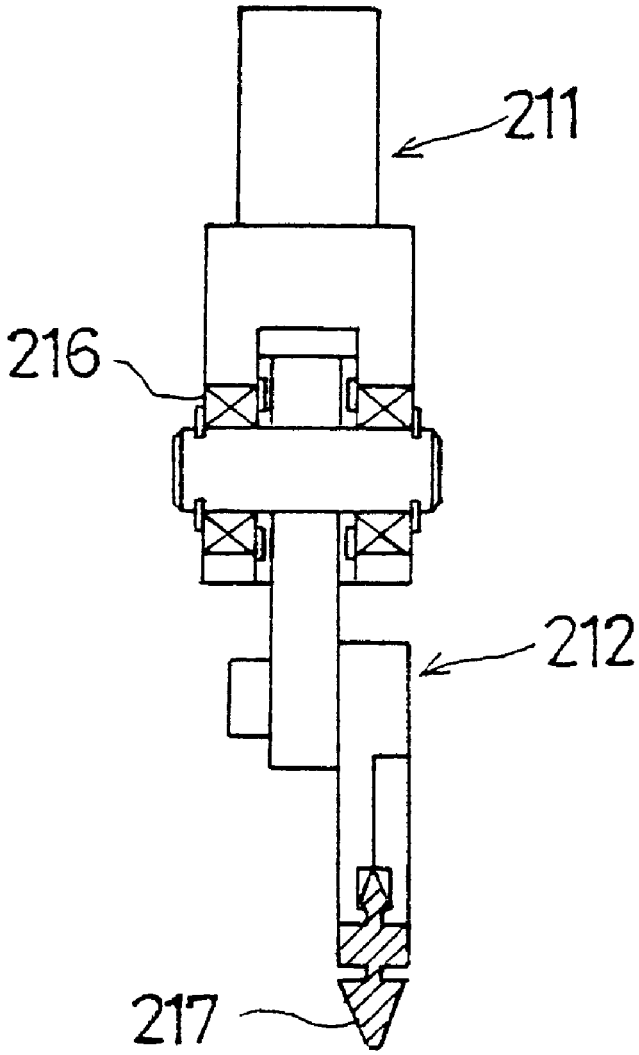
FIG. 32 is an expanded cross-sectional view along a line XXXII—XXXII of the wiper unit depicted in FIG. 29.

FIG. 28 is a perspective view of the wiper unit. FIG. 29 is a front view of the wiper unit. FIG. 30 is a plan view of the wiper unit. FIG. 31 is a side view of the wiper unit. FIG. 32 is an expanded cross-sectional view along a line XXXII—XXXII of the wiper unit depicted in FIG. 29.

As shown in FIGS. 28, 29, 30, 31 and 32, the wiper unit 78 comprises a base 210, an arm 211, a blade 212 and a piston 213. The arm 211 is supported on the base 210 by a shaft 214 seated on a bearing 215. The blade 212 is attached to one side of the arm 211 by a bearing 216 and has a rubber edge portion 217. The piston 213 is fixedly mounted on a rod frame 218 mounted on a top of the base 210. A link 220 connects a rod 219 extending from a bottom of the piston 213 to a side of the arm 211 other than the side to which the blade 212 is attached.

The wiper unit 78 is usually separated from the rotary lapping plate 72, with the blade 212 raised to a position approximately at right angles with respect to the surface of the rotary lapping plate 72.

The operation of lowering the wiper that constitutes the step S10 in FIG. 11 involves activating the piston 213 so as to draw the piston rod 219 upward in the Z1 direction as shown in FIG. 29, rotating the arm 211 counter-clockwise and contacting the blade 217 against the upper surface of the rotary lapping plate 72. The wiper unit 78 is then held in such position for a predetermined period of time in the step S11. During this predetermined period of time the wiper unit 78 removes the slurry containing the diamond powder from the upper surface of the rotary lapping plate 72, leaving only the diamond-powderless slurry on the upper surface of the rotary lapping plate 72. In other words, the upper surface of the rotary lapping plate 72 is in an appropriate state for fine lapping of the row bar 22.

The blade 217 of the wiper unit 78 contacts the rotary lapping plate 72 not precisely along the radial direction of the rotary lapping plate 72 but is offset at an angle to the radial direction of the rotary lapping plate 72 shown as θ in FIG. 30. This offset helps the wiper unit 78 to remove slurry from the surface of the rotary lapping plate 72 more effectively and deliver it to the outside of the rotary lapping plate 72.

In general, the closer to a center of the rotary lapping plate 72 the more difficult it becomes to remove slurry from the rotary lapping plate 72. Accordingly, the blade 217 is made to contact the upper surface of the rotary lapping plate 72 with greater force toward the center of the rotary lapping plate 72 than toward the periphery of the rotary lapping plate 72.

The operation of lifting the wiper blade 217 off the upper surface of the rotary lapping plate 72 in step S12 is carried out after it has been determined in step S11 that a predetermined period of time has elapsed. That is, the piston 213 is activated and the piston rod 219 is moved downward in the Z2 direction, the arm 211 is rotated clockwise and the blade 217 is separated from the upper surface of the rotary lapping plate 72, assuming the position shown by a double-dot-and-chain line in FIG. 29.

It will be appreciated by those skilled in the art that the above-described lapping apparatus and method are not limited to lapping row bars for the purpose of obtaining slider-mounted composite magnetic heads but can be adapted for lapping other component parts as well.

The above description is provided in order to enable any person skilled in the art to make and use the invention and sets forth the best mode contemplated by the inventors of carrying out the invention.

The present invention is not limited to the specifically disclosed embodiments, and variations and modifications may be made without departing from the scope and spirit of the present invention.

The present application is based on Japanese Priority Application No. 11-348147, filed on Dec. 7, 1999, the entire contents of which are hereby incorporated by reference.

What is claimed is:

1. A lapping method including a step of moving a substantially bar-shaped workpiece in a radial direction of a surface of a rotary lapping plate while simultaneously oscillating the workpiece pivotally about a central point in a longitudinal direction of the workpiece in a plane parallel to the surface of the rotary lapping plate, said step of moving said workpiece in said radial direction and said step of oscillating said workpiece being conducted by driving a single actuator.

2. The lapping method as claimed in claim 1, wherein a period of a cycle of the pivotal oscillation of the workpiece is different from a period of a cycle of the movement of the workpiece in the radial direction of the rotary lapping plate.

3. The lapping method as claimed in claim 1, further comprising a step of removing a rough slurry supplied to an upper surface of the rotary lapping plate before a smooth slurry is supplied to the upper surface of the rotary lapping plate.

4. A lapping apparatus comprising:

a rotary lapping plate;

an arcuate movement mechanism returnably moving a substantially bar-shaped workpiece repeatedly in a radial direction of a surface of the rotary lapping plate; and an oscillating mechanism oscillating the workpiece pivotally about a central point in a longitudinal direction of the workpiece in a plane parallel to the surface of the rotary lapping plate, the oscillating mechanism being supported on and by the arcuate movement mechanism, said oscillating mechanism being driven by said arcuate movement mechanism.

5. The lapping apparatus as claimed in claim 4, wherein a period of a cycle of the arcuate movement mechanism differs from a period of a cycle of the oscillating mechanism, such that the workpiece is continuously in motion.

6. A lapping apparatus comprising:

a rotary lapping plate;

an oscillating mechanism oscillating a workpiece pivotally about a central point of the workpiece while maintaining the workpiece in sliding contact with an upper surface of the rotary lapping plate, the mechanism having a stopper that slidingly contacts the upper surface of the rotary lapping plate; and a loading/unloading mechanism that moves the stopper of the oscillating mechanism in a loading direction toward the rotary lapping plate and an unloading direction away from the rotary lapping plate.

7. The lapping apparatus as claimed in claim 6, the stopper having an aperture releasing a flow of compressed air, the aperture being formed in a surface of the stopper that contacts the upper surface of the rotary lapping plate.

8. The lapping apparatus as claimed in claim 7, wherein the flow of compressed air is released from the aperture in the stopper at least when the oscillating mechanism and the stopper are moved in the unloading direction away from the rotary lapping plate.

9. A lapping apparatus comprising:

a rotary lapping plate;

an oscillating mechanism oscillating a workpiece pivotally about a central point of the workpiece while maintaining the workpiece in sliding contact with an upper surface of the rotary lapping plate, the mechanism having a stopper that slidingly contacts the upper surface of the rotary lapping plate; and a wiper unit having a blade portion that contacts the upper surface of the rotary lapping plate, the wiper unit being activated to remove a rough slurry supplied to the upper surface of the rotary lapping plate before a smooth slurry is supplied to the upper surface of the rotary lapping plate.

10. The wiper unit as claimed in claim 9, wherein a blade portion of the wiper unit is set at an angle with respect to the radial direction of the rotary lapping plate when the wiper unit contacts the blade against the upper surface of the rotary lapping plate.

* * * * *